US010017293B2

(12) United States Patent
Spivey, Sr.

(10) Patent No.: US 10,017,293 B2
(45) Date of Patent: Jul. 10, 2018

(54) MODULAR CARTON

(71) Applicant: Graphic Packaging International, Inc., Atlanta, GA (US)

(72) Inventor: Raymond R. Spivey, Sr., Mableton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/222,149

(22) Filed: Jul. 28, 2016

(65) Prior Publication Data

US 2017/0029185 A1 Feb. 2, 2017

Related U.S. Application Data

(60) Provisional application No. 62/282,271, filed on Jul. 29, 2015, provisional application No. 62/282,661, filed on Aug. 7, 2015.

(51) Int. Cl.
*B65D 71/38* (2006.01)
*B65D 5/468* (2006.01)
(Continued)

(52) U.S. Cl.
CPC ..... *B65D 5/4608* (2013.01); *B65D 5/0227* (2013.01); *B65D 5/48024* (2013.01);
(Continued)

(58) Field of Classification Search
CPC ..... B65D 71/38; B65D 5/32; B65D 5/4608; B65D 5/0227; B65D 2571/00141; B65D 2571/00401
(Continued)

(56) References Cited

U.S. PATENT DOCUMENTS 1,120,752 A 12/1914 Smiley
1,896,326 A 2/1933 Northway-Ley
(Continued)

FOREIGN PATENT DOCUMENTS

CH 263456 8/1949
DE 88 14 144.6 1/1989
(Continued)

OTHER PUBLICATIONS

International Search Report and Written Opinion for PCT/US2016/044448 dated Nov. 10, 2016.

*Primary Examiner* — Steven A. Reynolds
(74) *Attorney, Agent, or Firm* — Womble Bond Dickinson (US) LLP

(57) ABSTRACT

A carton for holding a plurality of articles in at least a first layer and a second layer. The carton can include a plurality of panels extending at least partially around an interior of the carton. The plurality of panels can include at least a bottom panel, a side panel, and a top panel. The carton further can include a divider for at least partially extending between the first layer and the second layer of the plurality of articles. The divider can at least partially define a first modular section of the carton and a second modular section of the carton. The first modular section can include the top panel, an upper portion of the side panel, and the divider. The second modular section can include the bottom panel and a lower portion of the side panel. The first modular section can be at least partially separable from the second modular section.

42 Claims, 21 Drawing Sheets

(51) Int. Cl.

| | |
|---|---|
| ***B65D 5/02*** | (2006.01) |
| ***B65D 71/36*** | (2006.01) |
| ***B65D 5/49*** | (2006.01) |
| ***B65D 5/54*** | (2006.01) |

(52) U.S. Cl.
CPC ..... *B65D 5/541* (2013.01); *B65D 5/542* (2013.01); *B65D 71/36* (2013.01); *B65D 2571/0058* (2013.01); *B65D 2571/00141* (2013.01); *B65D 2571/00401* (2013.01); *B65D 2571/00444* (2013.01); *B65D 2571/00567* (2013.01); *B65D 2571/00728* (2013.01); *B65D 2571/00808* (2013.01); *B65D 2571/00864* (2013.01)

(58) Field of Classification Search
USPC ..... 206/427
See application file for complete search history.

(56) References Cited

U.S. PATENT DOCUMENTS

| | | | | |
|---|---|---|---|---|
| 1,898,646 | A | 2/1933 | Taylor | |
| 2,111,376 | A | 3/1938 | Van Wingen | |
| 2,151,472 | A | 3/1939 | Hubbard | |
| 2,312,846 | A | 3/1943 | Olvey | |
| 2,475,107 | A | 7/1949 | Newsom | |
| 2,758,774 | A | 8/1956 | Grunert et al. | |
| 2,844,294 | A | 7/1958 | Williams | |
| 2,854,050 | A | 9/1958 | Di Padova | |
| 2,875,942 | A | 3/1959 | Wilson | |
| 3,006,523 | A | 10/1961 | Keith | |
| 3,101,880 | A | 8/1963 | Peterson | |
| 3,158,312 | A * | 11/1964 | Simkins | B65D 5/5495 229/120.011 |
| 3,664,494 | A | 5/1972 | Mergens | |
| 3,732,976 | A | 5/1973 | Bessett et al. | |
| 3,822,785 | A | 7/1974 | Getz et al. | |
| 3,937,326 | A | 2/1976 | Schick | |
| 4,105,154 | A | 8/1978 | Meyers et al. | |
| 4,120,443 | A | 10/1978 | Gardner et al. | |
| 4,138,052 | A | 2/1979 | Torigian | |
| 4,421,229 | A * | 12/1983 | Pan | B65D 5/5445 206/750 |
| 4,530,459 | A | 7/1985 | Maroszek | |
| 4,577,799 | A | 3/1986 | Oliff | |
| 4,621,766 | A | 11/1986 | McClure | |
| 4,739,921 | A | 4/1988 | Taub | |
| 4,811,837 | A | 3/1989 | Larizza | |
| 4,919,269 | A * | 4/1990 | Wright | B65D 5/48014 229/120.011 |
| 5,076,492 | A | 12/1991 | Tupes | |
| 5,190,211 | A | 3/1993 | Stoddard et al. | |
| 5,234,102 | A | 8/1993 | Schuster et al. | |
| 5,246,113 | A | 9/1993 | Schuster | |
| 5,316,210 | A | 5/1994 | Scullin | |
| 5,415,344 | A | 5/1995 | Harrelson | |
| 5,427,242 | A | 6/1995 | Oliff et al. | |
| 5,437,143 | A | 8/1995 | Culpepper et al. | |
| 5,518,111 | A | 5/1996 | Stout | |
| 5,538,130 | A | 7/1996 | Harrelson | |
| 5,620,094 | A | 4/1997 | Naumann | |
| 5,669,500 | A | 9/1997 | Sutherland | |
| 5,682,984 | A | 11/1997 | Hoell et al. | |
| 5,699,957 | A | 12/1997 | Blin et al. | |
| 5,772,030 | A | 6/1998 | Baxter | |
| 5,813,540 | A | 9/1998 | Vollbrecht et al. | |
| 5,826,783 | A | 10/1998 | Stout | |
| 5,826,870 | A | 10/1998 | Vulgamore et al. | |
| 5,848,686 | A | 12/1998 | Dean | |
| 5,853,088 | A | 12/1998 | Saulas et al. | |
| 5,868,252 | A | 2/1999 | Oliff | |
| 5,938,109 | A | 8/1999 | Sainz et al. | |
| 5,957,288 | A | 9/1999 | Campbell | |
| 5,967,406 | A | 10/1999 | Moorman | |
| 5,996,883 | A | 12/1999 | Bates | |
| 6,012,630 | A | 1/2000 | Block | |
| 6,065,590 | A | 5/2000 | Spivey | |
| 6,112,977 | A | 9/2000 | Sutherland et al. | |
| 6,176,419 | B1 | 1/2001 | Holley, Jr. | |
| 6,244,502 | B1 | 6/2001 | Hollar et al. | |
| 6,250,542 | B1 | 6/2001 | Negelen | |
| 6,386,369 | B2 | 5/2002 | Yuhas et al. | |
| 6,402,020 | B1 | 6/2002 | McClure | |
| 6,918,487 | B2 | 7/2005 | Harrelson | |
| 6,926,193 | B2 | 8/2005 | Smalley | |
| 6,991,107 | B2 | 1/2006 | Harrelson | |
| 7,093,713 | B2 | 8/2006 | Sutherland | |
| 7,168,558 | B2 | 1/2007 | Harrelson | |
| 7,195,118 | B2 | 3/2007 | Sutherland | |
| 7,270,259 | B2 | 9/2007 | Sutherland | |
| 7,475,778 | B2 | 1/2009 | Sutherland | |
| 7,578,427 | B2 | 8/2009 | Durnin | |
| 7,717,321 | B2 | 5/2010 | Spivey, Sr. et al. | |
| 7,793,821 | B2 | 9/2010 | Oliveira | |
| 7,823,721 | B2 | 11/2010 | Sutherland et al. | |
| 7,832,622 | B2 | 11/2010 | Spivey, Sr. | |
| 8,127,980 | B2 | 3/2012 | Spivey, Sr. et al. | |
| 8,459,535 | B2 | 6/2013 | Brand | |
| 8,628,000 | B2 | 1/2014 | Spivey, Sr. et al. | |
| 9,132,936 | B2 | 9/2015 | Kohler | |
| 9,415,915 | B2 | 8/2016 | Spivey, Sr. et al. | |
| 2003/0080180 | A1 | 5/2003 | Holley et al. | |
| 2004/0155098 | A1 | 8/2004 | Harrelson | |
| 2004/0245327 | A1 * | 12/2004 | Oliff | B65D 5/5495 229/120.011 |
| 2005/0023331 | A1 | 2/2005 | Hirschey | |
| 2005/0067477 | A1 | 3/2005 | McClure | |
| 2005/0115843 | A1 | 6/2005 | Harrelson | |
| 2005/0167290 | A1 | 8/2005 | Sutherland | |
| 2005/0167292 | A1 | 8/2005 | Sutherland | |
| 2005/0173269 | A1 * | 8/2005 | Lebras | B65D 5/324 206/170 |
| 2005/0189406 | A1 | 9/2005 | Welchel et al. | |
| 2006/0283926 | A1 | 12/2006 | Drunin | |
| 2007/0170232 | A1 | 7/2007 | Spivey | |
| 2011/0132978 | A1 | 6/2011 | de Sousa | |
| 2013/0256392 | A1 * | 10/2013 | Kohler | B65D 5/72 229/117.12 |

FOREIGN PATENT DOCUMENTS

| | | |
|---|---|---|
| DE | 91 11 941.3 | 1/1992 |
| EP | 0 595 602 | 5/1994 |
| FR | 1427897 | 4/1966 |
| FR | 1489087 | 7/1967 |
| FR | 1497652 | 10/1967 |
| FR | 2223985 | 10/1974 |
| FR | 2626256 | 7/1989 |
| GB | 434145 | 8/1935 |
| GB | 2 198 709 | 6/1988 |
| GB | 2 323 352 | 9/1998 |
| JP | 62-62617 | 10/1985 |
| JP | 62-130024 | 8/1987 |
| JP | 1-73121 | 5/1989 |
| JP | 5-7621 | 2/1993 |
| JP | 7-125745 | 5/1995 |
| JP | 9-142449 | 6/1997 |
| JP | 11-130049 | 5/1999 |
| JP | 2000-85754 | 3/2000 |
| JP | 2000-238779 | 9/2000 |
| JP | 2002-526346 | 8/2002 |
| WO | WO 92/07772 | 5/1992 |
| WO | WO 96/29261 | 9/1996 |
| WO | WO 98/56684 | 12/1998 |
| WO | WO 99/28198 | 6/1999 |
| WO | WO 00/20288 | 4/2000 |
| WO | WO 01/30659 | 5/2001 |
| WO | WO 02/30764 | 4/2002 |
| WO | WO 2004/014755 | 2/2004 |

* cited by examiner

MODULAR CARTON

CROSS-REFERENCE TO RELATED APPLICATIONS

This application claims the benefit of U.S. Provisional Patent Application No. 62/282,271, filed on Jul. 29, 2015, and U.S. Provisional Patent Application No. 62/282,661, filed on Aug. 7, 2015.

BACKGROUND OF THE DISCLOSURE

The disclosures of U.S. Provisional Patent Application No. 62/282,271, filed Jul. 29, 2015, and U.S. Provisional Patent Application No. 62/282,661, filed Aug. 7, 2015, are hereby incorporated by reference as if presented herein in their entirety and are incorporated by reference for all purposes.

BACKGROUND OF THE DISCLOSURE

The present disclosure generally relates to cartons for holding beverage containers or other types of articles. More specifically, the present disclosure relates to modular cartons that are separable into first and second cartons.

SUMMARY OF THE DISCLOSURE

In general, one aspect of the disclosure is generally directed to a carton for holding a plurality of articles in at least a first layer and a second layer. The carton can comprise a plurality of panels extending at least partially around an interior of the carton. The plurality of panels can comprise at least a bottom panel, a side panel, and a top panel. The carton further can include a divider for at least partially extending between the first layer and the second layer of the plurality of articles. The divider can at least partially define a first modular section of the carton and a second modular section of the carton. The first modular section can comprise the top panel, an upper portion of the side panel, and the divider. The second modular section can comprise the bottom panel and a lower portion of the side panel. At least a portion of the divider can be for at least partially supporting the first layer of the plurality of articles, the bottom panel can be for at least partially supporting the second layer of the plurality of articles, and the first modular section can be at least partially separable from the second modular section.

In another aspect, the disclosure is generally directed to a combination of a carton blank and a divider blank for forming a carton for holding a plurality of articles in at least a first layer and a second layer. The carton blank can comprise a plurality of panels comprising at least a bottom panel, a side panel, and a top panel. The divider blank can at least partially overlap the carton blank. The divider blank can be for at least partially extending between the first layer and the second layer of the plurality of articles when the carton is formed from the carton blank and the divider blank. The divider blank can be for at least partially defining a first modular section of the carton formed from the carton blank and the divider blank and a second modular section of the carton formed from the carton blank and the divider blank. The first modular section can be for comprising the top panel, an upper portion of the side panel, and the divider formed from the divider blank, and the second modular section can be for comprising the bottom panel and a lower portion of the side panel. At least a portion of the divider blank can be for at least partially supporting the first layer of the plurality of articles, the bottom panel can be for at least partially supporting the second layer of the plurality of articles, and the first modular section can be at least partially separable from the second modular section when the carton is formed from the carton blank and the divider blank.

In another aspect, the disclosure is generally directed to a method of forming a carton for holding a plurality of articles in at least a first layer and a second layer. The method can comprise obtaining a carton blank and a divider blank. The carton blank can comprise a plurality of panels comprising at least a bottom panel, a side panel, and atop panel. The method further can comprise at least partially overlapping the divider blank and the carton blank, positioning the plurality of panels to at least partially form an interior of the carton, and forming the divider blank into a divider at least partially extending between the first layer and the second layer of the plurality of articles. The forming the divider can comprise at least partially defining a first modular section of the carton and a second modular section of the carton. The first modular section can comprise the top panel, an upper portion of the side panel, and the divider, and the second modular section can comprise the bottom panel and a lower portion of the side panel. At least a portion of the divider can be for at least partially supporting the first layer of the plurality of articles, the bottom panel can be for at least partially supporting the second layer of the plurality of articles, and the first modular section can be at least partially separable from the second modular section.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be beverage containers used for packaging beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. The present disclosure generally relates to cartons housing a plurality of articles and a divider positioned between layers of articles. The articles in each layer can be of the same size and shape or the articles in each layer can be a different size and shape without departing from the disclosure. In this specification, the terms "inner," "outer," "lower," "bottom," "upper," and "top" indicate orientations determined in relation to fully erected and upright cartons.

Figure 1:
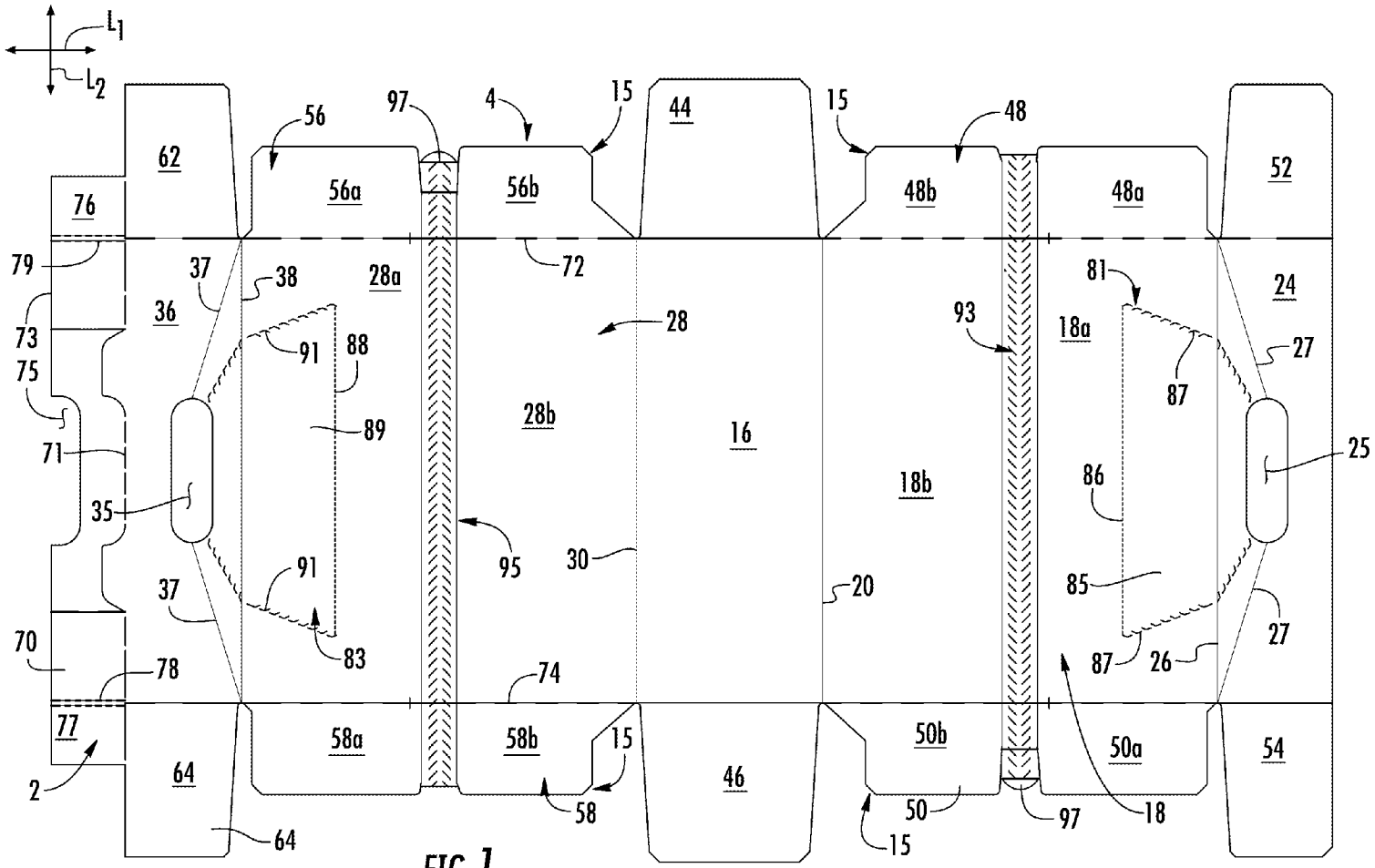
FIG. 1 is an exterior plan view of a blank used to form a carton according to a first exemplary embodiment of the disclosure.

FIG. 1 is a plan view of the exterior side 2 of a blank, generally indicated at 4, used to form a carton 6 (FIGS. 7A and 7B) according to one embodiment of the disclosure. The carton 6 can be used to house a plurality of articles such as containers C1, C2 (FIG. 6) arranged in two layers or tiers T1, T2, with the top layer T1 including containers C1 and the bottom layer T2 including containers C2. In the illustrated embodiment, the containers C1, C2 are different from one another (e.g., the containers C1 could be 7.5 ounce cans and the containers C2 could be 10.5 ounce cans, wherein, in one embodiment, the containers C2 can be generally taller than the containers C1 and the containers C1, C2 can have a generally similar or identical diameter). Alternatively, the containers C1, C2 could be similar or identical to one another. In the first embodiment, the carton 6 is sized to house twenty containers C1, C2 in a 2×5×2 arrangement, but it is understood that the carton 6 may be sized and shaped to hold containers C of a different or same quantity in more than two layers and/or in different row/column arrangements (e.g., 1×6×2, 3×6×2, 2×6×2, 3×5×2, 3×4×2, 4×5×2, etc.). The containers C1, C2 could be otherwise shaped, arranged, and/or configured without departing from the disclosure. For example, the containers C1, C2 could be beverage bottles or other containers. In the illustrated embodiment, the carton 6 includes a handle, generally indicated at 12 (FIGS. 7A-8 and 9B-10B), for grasping and carrying the carton.

The blank 4 has a longitudinal axis L1 and a lateral axis L2. In the illustrated embodiment, the blank 4 comprises a bottom panel 16 foldably connected to a first side panel 18 at a first lateral fold line 20, a first top panel 24 foldably connected to the first side panel 18 at a second lateral fold line 26, a second side panel 28 foldably connected to the bottom panel 16 at a third lateral fold line 30, and a second top panel 36 foldably connected to the second side panel 28 at a fourth lateral fold line 38. Any of the top panels 24, 36, the bottom panel 16, and the side panels 18, 28 could be omitted or could be otherwise shaped, arranged, and/or configured without departing from the disclosure.

The bottom panel 16 is foldably connected to a first bottom end flap 44 and a second bottom end flap 46. The first side panel 18 is foldably connected to a first side end flap 48 and a second side end flap 50. The first top panel 24 is foldably connected to a first top end flap 52 and a second top end flap 54. The second side panel 28 is foldably connected to a first side end flap 56 and a second side end flap 58. The second top panel 36 is foldably connected to a third top end flap 62 and a fourth top end flap 64. When the carton 6 is erected, the end flaps 44, 48, 52, 56, 62 close a first end 67 of the carton, and the end flaps 46, 50, 54, 58, 64 close a second end 69 of the carton. In accordance with an alternative embodiment of the present disclosure, different flap arrangements can be used for closing the ends of the carton 6.

The end flaps 44, 48, 52, 56, 62 extend along a first marginal area of the blank 4, and are foldably connected at a first longitudinal fold line 72 that extends along the length of the blank. The end flaps 46, 50, 54, 58, 64 extend along a second marginal area of the blank 4, and are foldably connected at a second longitudinal fold line 74 that also extends along the length of the blank. The longitudinal fold lines 72, 74 may be, for example, substantially straight, or offset at one or more locations to account for blank thickness or for other factors.

As shown in FIG. 1, the blank 4 includes handle features for forming the handle 12 of the carton 6. The handle features include a first opening 25 in the first top panel 24 and a second opening 35 in the second top panel 36. The handle features may include oblique fold lines 27, 37 extending from a respective opening 25, 35 to the fold lines 72, 74 at respective corners of the top panels 24, 36 to allow the first and second top panels to flex when the carton 6 is grasped and carried by the handle 12. In one embodiment, the handle features include a handle reinforcement panel 70 foldably connected to the second top panel 36 at a lateral fold line 71. As shown in FIG. 1, the handle reinforcement panel 70 has a cutout 75 at a laterally extending edge 73 of the blank 4 and two reinforcing end flaps 76, 77 adjacent the respective top end flaps 62, 64. The cutout 75 can be generally aligned with the handle openings 25, 35 along a longitudinal centerline of the blank 4. The reinforcing end flaps 76, 77 can be foldably connected to the reinforcement panel 70 along respective fold lines or fold areas 78, 79. The handle 12 and/or the handle reinforcement panel 70 could be omitted, could have other features, or could be otherwise shaped, arranged, and/or configured without departing from the disclosure.

In one embodiment, the blank 4 may include dispensing or opening features for forming a first dispenser 81 adjacent the first handle opening 25 and a second dispenser 83 adjacent the second handle opening 35. The first dispenser 81 includes a first dispenser panel 85 formed by two dispenser tear lines 87 extending from the first handle opening 25 in the first top panel 24 and the first side panel 18. The second dispenser includes a second dispenser panel 89 formed by two dispenser tear lines 91 extending from the second handle opening 35 in the second top panel 36 and the second side panel 28. In the illustrated embodiment, the dispenser panels 85, 89 are foldably connected to the respective side panels 18, 28 along respective fold line 86, 88. The dispensers 81, 83 could be omitted or could be otherwise shaped, arranged, and/or configured, without departing from the disclosure. For example, the fold lines 86, 88 could be tear lines.

In the embodiment of FIG. 1, the blank 4 includes separating features that comprise a first tear strip 93 extending across the blank 4 in the lateral direction L2 through the end flap 48, the first side panel 18, and the end flap 50. The separating features can comprise a second tear strip 95 extending across the blank 4 in the lateral direction L2 thorough the end flap 56, the second side panel 28, and the end flap 58. In one embodiment, each of the tear strips 93, 95 may comprise a pull tab 97 for grasping and removing the respective tear strip. The tear strips 93, 95 extend laterally across the entire width of the blank 4 between opposite peripheral edges of the blank. As shown in FIG. 1, each of the tear strips 93, 95 is defined by two spaced tear lines configured for tearing in opposite directions. Alternatively, the tear strips could be configured for tearing in the same direction. In the illustrated embodiment, the first tear strip 93 can extend between a first upper portion 18*a* and a first lower portion 18*b* of the first side panel 18, between an upper end portion 48*a* and a lower end portion 48*b* of the first side end flap 48, and between an upper end portion 50*a* and a lower end portion 50*b* of the second side end flap 50. Similarly, the second tear strip 95 can extend between a second upper portion 28*a* and a second lower portion 28*b* of the second side panel 28, between an upper end portion 56*a* and a lower end portion 56*b* of the first side end flap 56, and between an upper end portion 58*a* and a lower end portion 58*b* of the second side end flap 58. When the blank 4 is formed into a carton 6, the tear strips 93, 95 divide the carton into a first (upper) modular section 101 and a second (lower) modular section 103. Either of the tear strips 93, 95 could be omitted or could be otherwise shaped, arranged, and/or configured without departing from the disclosure. For example, the separating features for separating the first portion 101 and the second portion 103 could be other weakening features (e.g., cuts, tear lines, etc.) that are alternative to tear strips and still allow separation of the first portion and the second portion of the carton 6.

Figure 2:
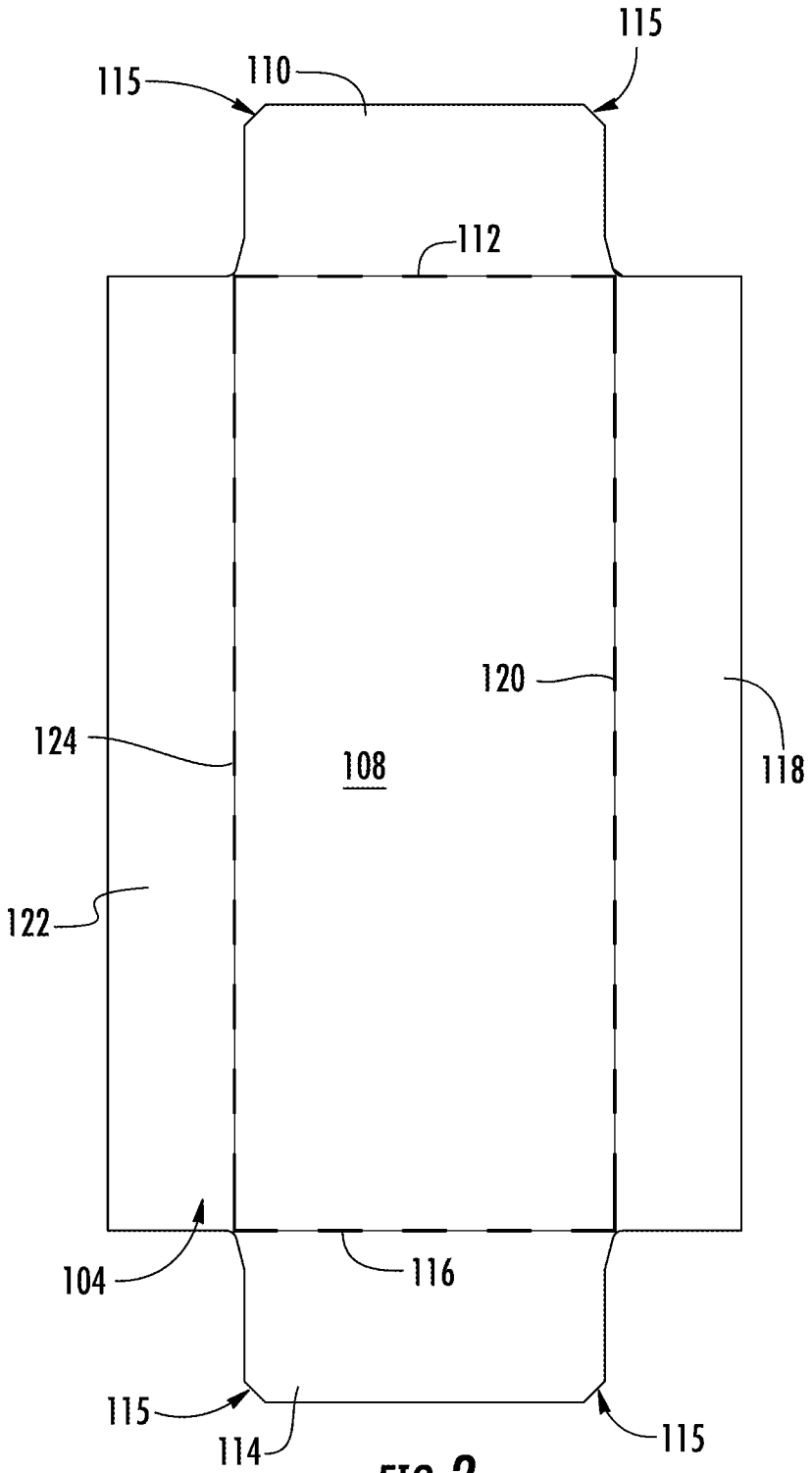
FIG. 2 is a plan view of a divider blank for forming a divider in the carton of FIG. 1.

FIG. 2 is a plan view of the exterior side of a divider blank, generally indicated at 104, used to than a divider 106 (FIGS. 5A-6 and 9A) in the carton 6 according to one embodiment of the disclosure. In the illustrated embodiment, the divider blank 104 comprises a central or divider panel 108 foldably connected to a first divider end flap 110 at a first lateral fold line 112 and a second divider end flap 114 at a second lateral fold line 116. The divider blank 104 can also include a first side attachment flap 118 foldably connected to the central panel 108 at a first longitudinal fold line 120 and a second side attachment flap 122 foldably connected to the central panel 108 at a second longitudinal fold line 124. The divider blank 104 could have other features or could be otherwise shaped, arranged, and/or configured without departing from the disclosure. For example, any of the attachment flaps 118, 122 and the divider end flaps 110, 114 could be omitted.

Figure 3:
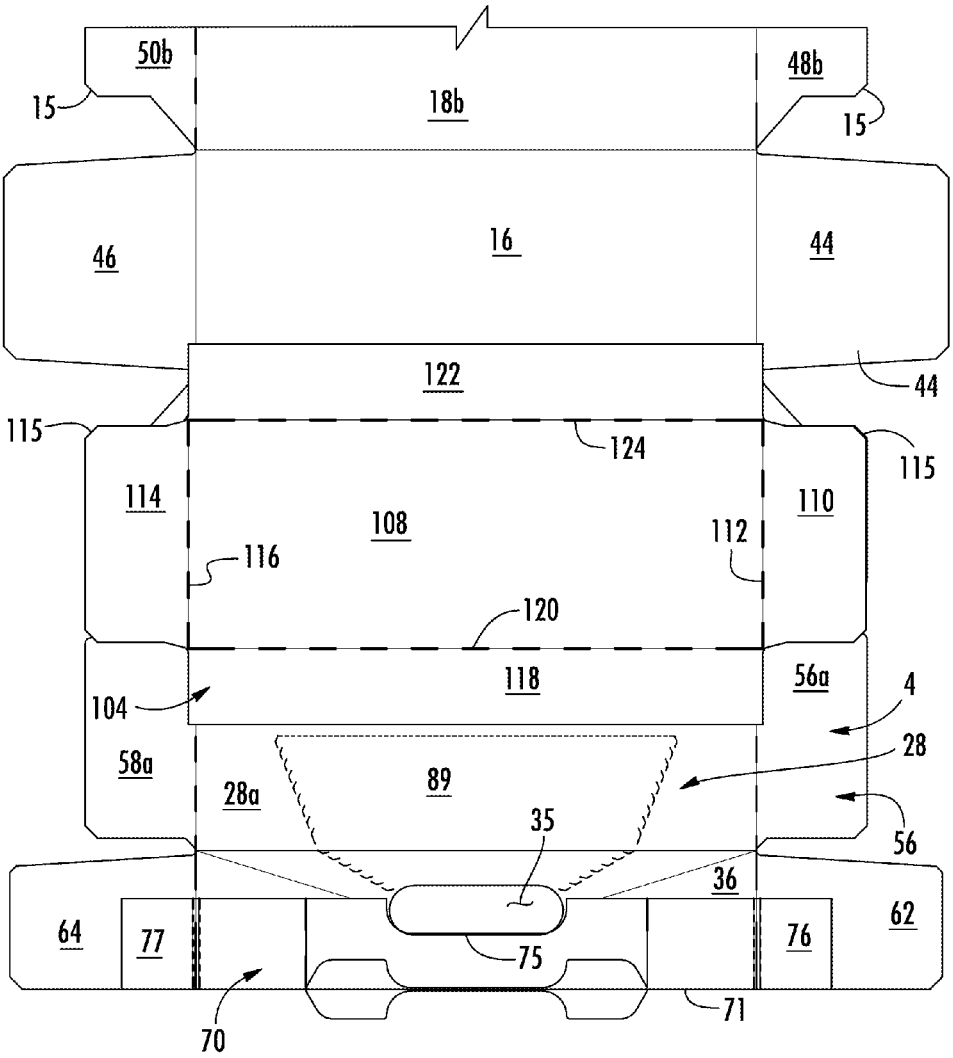
FIG. 3 is a plan view of the divider blank of FIG. 2 positioned on the carton blank of FIG. 1.

In accordance with one exemplary embodiment, the carton blank 4 and divider blank 104 can be erected into the carton 6 as generally shown in FIGS. 3-6. In one method of forming the carton 6, the carton blank 4 is positioned with its interior side facing upward and the divider blank 104 is positioned as shown in FIG. 3 to overlap the carton blank 4. In the illustrated embodiment, locating features or corners 115 of the divider end flaps 110, 114 of the divider blank 104 are aligned with respective locating features or corners 15 of the end flaps 56, 58 to properly position the attachment side flap 122 on the upper portion 28*a* of the side panel 28 (FIGS. 3 and 4A). In one embodiment, the corners 115 of the divider end flaps 110, 114 can be similar or identical in shape to at least a portion of each of the corners 15 of the lower portions 48*b*, 50*b*, 56*b*, 58*b* of the respective side end flaps 48, 50, 56, 58. For example, each of the corners 15, 115 can include a lateral edge, a longitudinal edge, and an oblique edge of the respective end flap so that when the respective edges are aligned (e.g., when the edges of a corner 115 of the divider end flap 110 are aligned with the edges of a corner 15 of the lower portion 56*b* and the edges of a corner 115 of the divider end flap 114 are aligned with the edges of a corner 15 of the lower portion 58*b*), such as by moving the edges against one or more guide plates (not shown), the divider can be positioned on the carton blank 104 so that the attachment side flap 118 can be adhered to the upper portion 28*a* of the side panel 28. The first side attachment flap 118 can be positioned into face-to-face contact with the second side panel 28 of the carton blank 4 and adhered thereto by glue or other adhesive. In the illustrated embodiment, the first side attachment flap 118 can be adhered to the upper portion 28*a* of the second side panel 28 and the central panel 108 can overlap the tear strip 95 and the lower portion 28*b* of the second side panel 28.

As shown in FIG. 3, the handle reinforcement panel 70 is folded along the fold line 73 into face-to-face contact with the interior surface of the second top panel 36 so that the handle cutout 75 is generally aligned with the handle opening 35 and the reinforcement end flaps 76, 77 overlap the respective top end flaps 62, 64. In the illustrated embodiment, the handle reinforcement panel 70 can be folded before or after positioning the divider blank 104 on the carton blank 4 and/or before or after adhering the first side attachment flap 118 to the upper portion 28*a* of the second side panel 28.

Figure 4A:
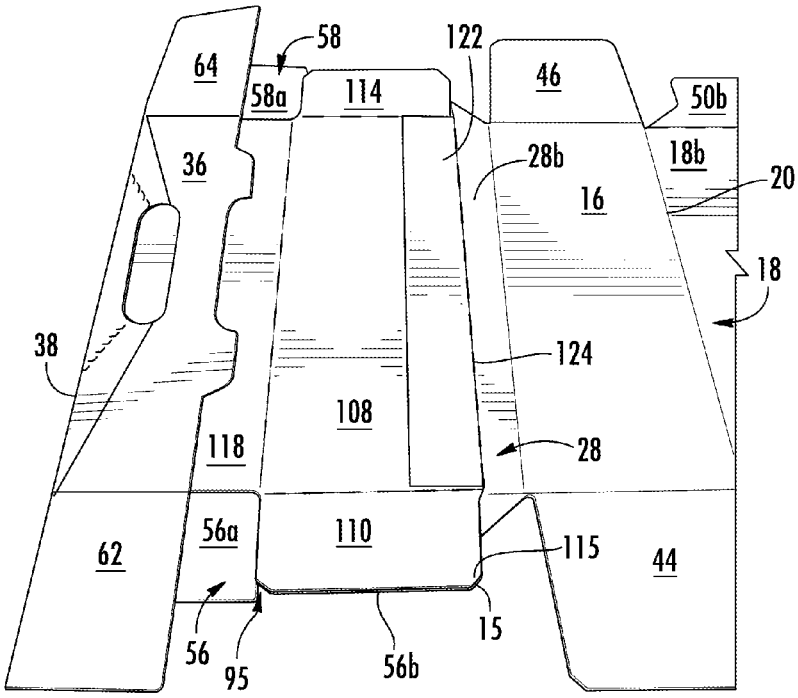
FIGS. 4A and 4B show the folding of the divider blank and the carton blank of FIG. 3 to form an open-ended sleeve.
Figure 4B:
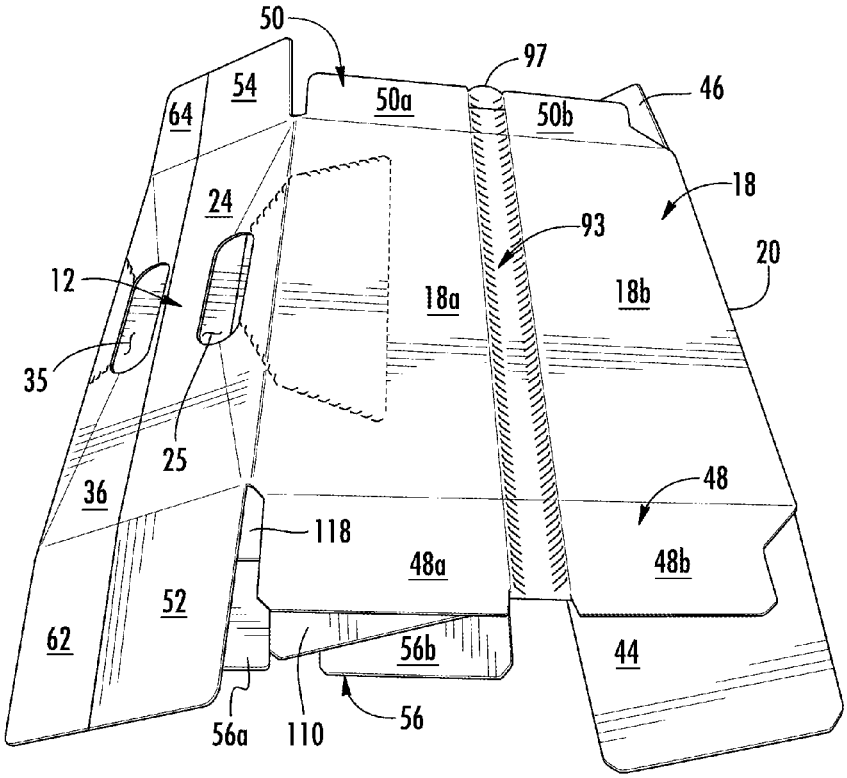

As shown in FIG. 4A, the second top panel 36 of the carton blank 4 can be folded along fold line 38 to at least partially overlap the upper portion 28*a* of the second side panel 28 and the first side attachment flap 118 of the divider blank 104. Additionally, the second side attachment flap 122 can be folded along fold line 124 to be in face-to-face contact with the divider panel 108. In one embodiment, the second top panel 36 and the second side attachment flap 122 could be folded in any order or simultaneously. As shown in FIG. 4B, the first side panel 18 can be folded along the fold line 20 so that the first top panel 24 overlaps at least a portion of the exterior side of the second top panel 36. The first top panel 24 can be glued to the overlapped portion of the second top panel 36 and the end flaps 52, 54 can be glued to the overlapped portions of the end flaps 62, 64. As the first side panel 18 is folded about fold line 20, the second side attachment flap 122 of the divider blank 104 and upper portion 18*a* of the first side panel 18 can be positioned into face-to-face contact and adhered by glue or other adhesive. At this point, the divider blank 104 is attached to the carton blank 4 in the collapsed position shown in FIG. 4B by way of the adhesive attachment of the first side attachment flap 118 to the upper portion 28*a* of the second side panel 28 and the adhesive attachment of the second side attachment flap 122 to the upper portion 18*a* of the first side panel 18.

Figure 5A:
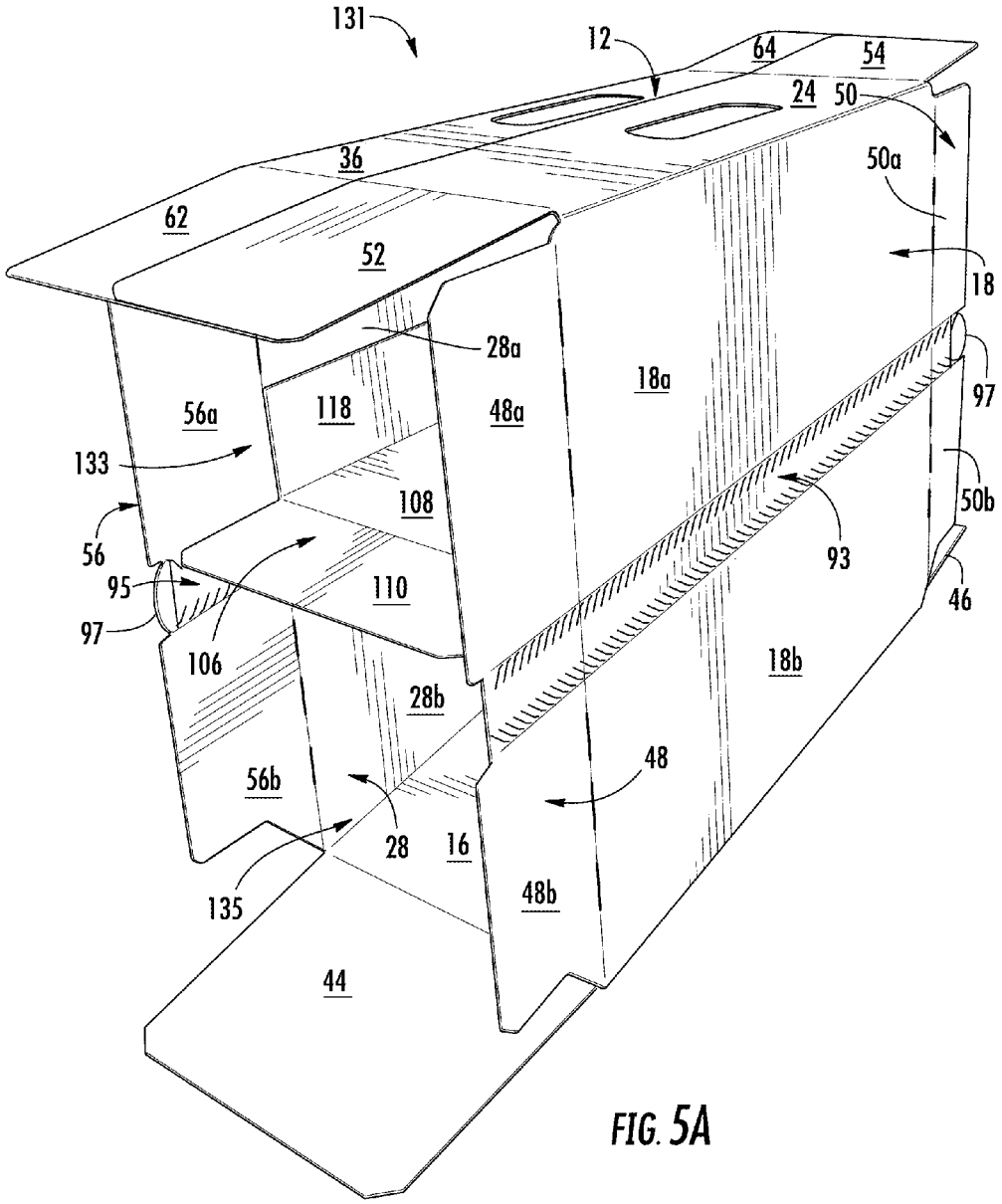
FIG. 5A is an exterior perspective view of the open-ended sleeve formed from the carton blank of FIG. 1 and the divider blank of FIG. 2.
Figure 5B:
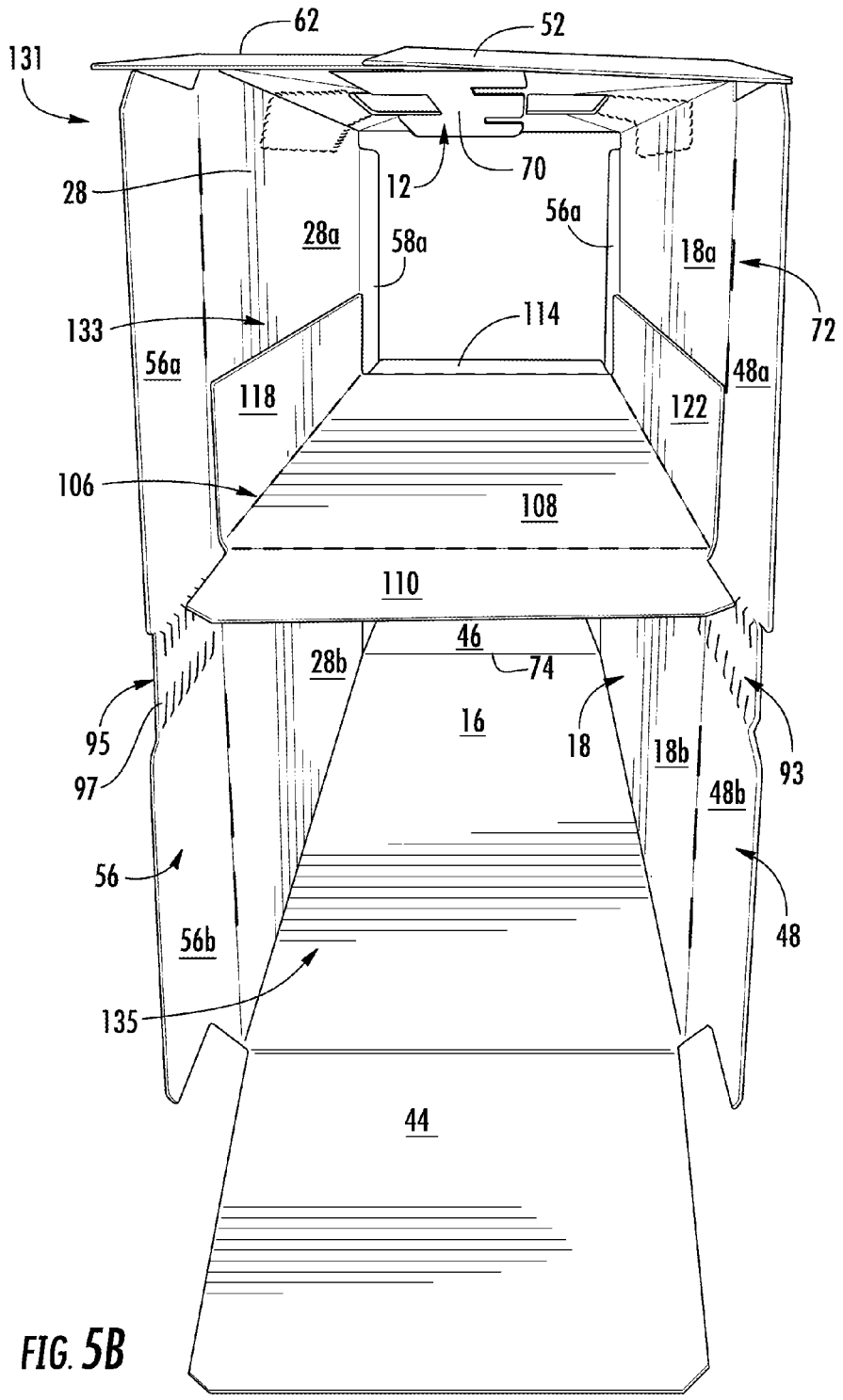
FIG. 5B is an interior perspective view of the open-ended sleeve of FIG. 5A.
Figure 6:
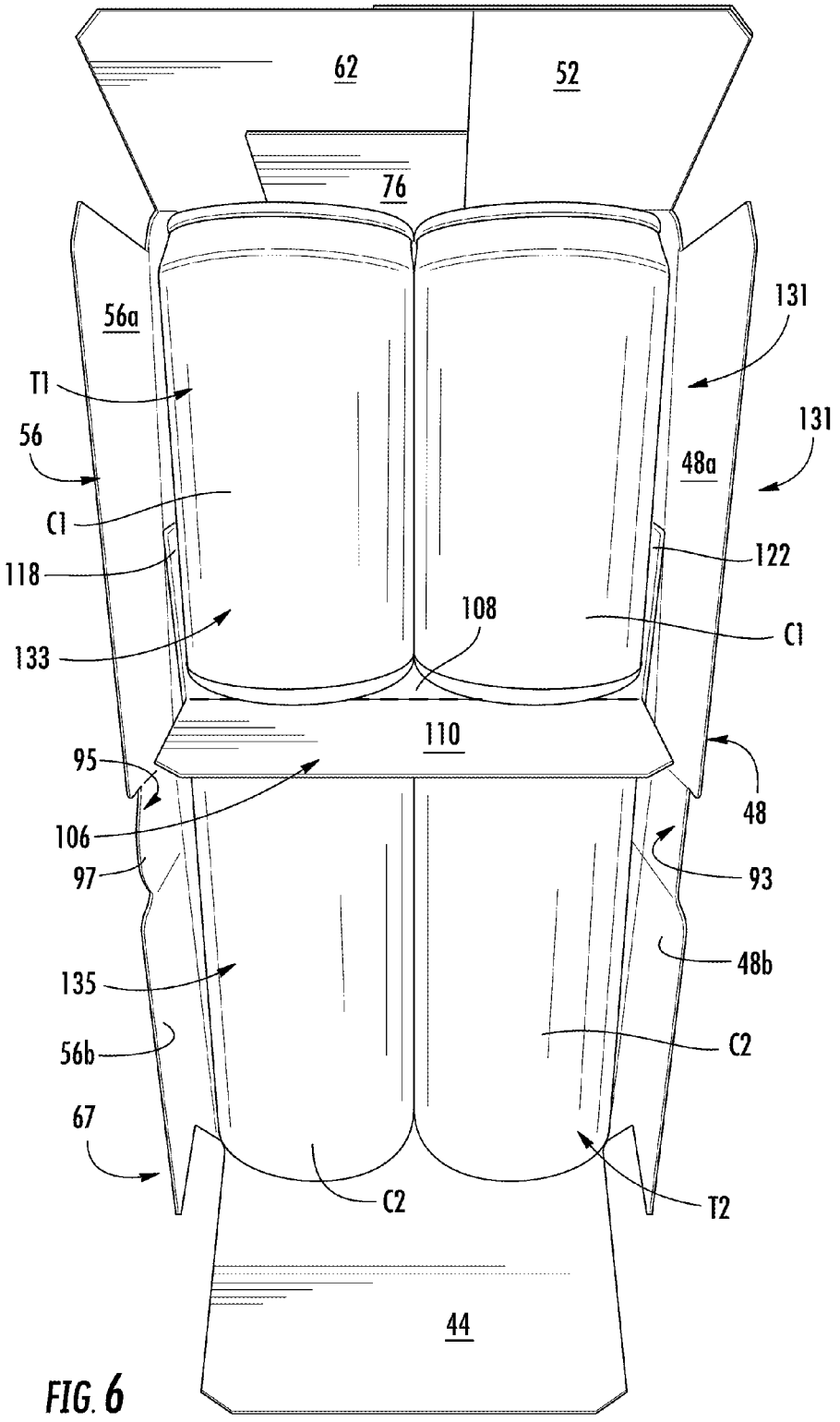
FIG. 6 is a perspective end view of the open-ended sleeve of FIGS. 5A and 5B loaded with containers.

The attached carton blank 4 and divider blank 104 then can be folded along fold lines 20, 26, 30, 38 to form an open-ended sleeve 131 and divider 106 disposed therein (FIGS. 5A-6). In the illustrated embodiment, the divider 106 can divide the interior of the sleeve into an upper space 133 and lower space 135. As shown in FIG. 6, the containers C1, C2 can be loaded into the interior of the open-ended sleeve 131 with the upper layer T1 of containers C1 being arranged in the upper space 133 of the interior and supported on the central panel 108 of the divider 106 and with the lower layer T2 of containers C2 being arranged in lower space 135 of the interior and supported on the bottom panel 16. The attached carton blank 4 and divider blank 104 may be otherwise formed into the open-ended sleeve 131 and divider 106 using alternative folding and gluing steps without departing from the scope of this disclosure.

The ends 67, 69 of the carton 5 can be closed by at least partially overlapping and adhering the end flaps 44, 48, 52, 56, 62, 76 at the first end 67 of the carton and at least partially overlapping and adhering the end flaps 46, 50, 54, 58, 64, 77 at the second end 69 of the carton. The overlapped top end flaps at each end (e.g., 52, 62 at end 67) are downwardly folded and secured to the side end flaps (e.g., 48, 56) at the same end. The bottom end flap (e.g., 44) can be upwardly folded and secured to the side end flaps (e.g., 48, 56) at the same end. In one embodiment, the side end flaps 48, 56 at the first end 67 can be slightly spaced apart (FIG. 7B) and the side end flaps 50, 58 at the second end 69 can be slightly spaced apart so that a respective opening is formed adjacent the ends of the tear strips 93, 95, which opening can make it easier to grasp the respective pull tab 97 at each end for initiating tearing of the respective tear strips 93, 95. The ends 67, 69 of the carton 5 could be closed by other closing steps and features without departing from the disclosure. For example, the side end flaps could at least partially overlap one another at the closed ends and/or the tear strips 93, 95 could at least partially overlap one another at one or both ends to form a substantially continuous tear strip. Further, the carton 5 can be alternatively loaded, such as by loading the containers after closing either of the ends 67, 69.

Figure 7A:
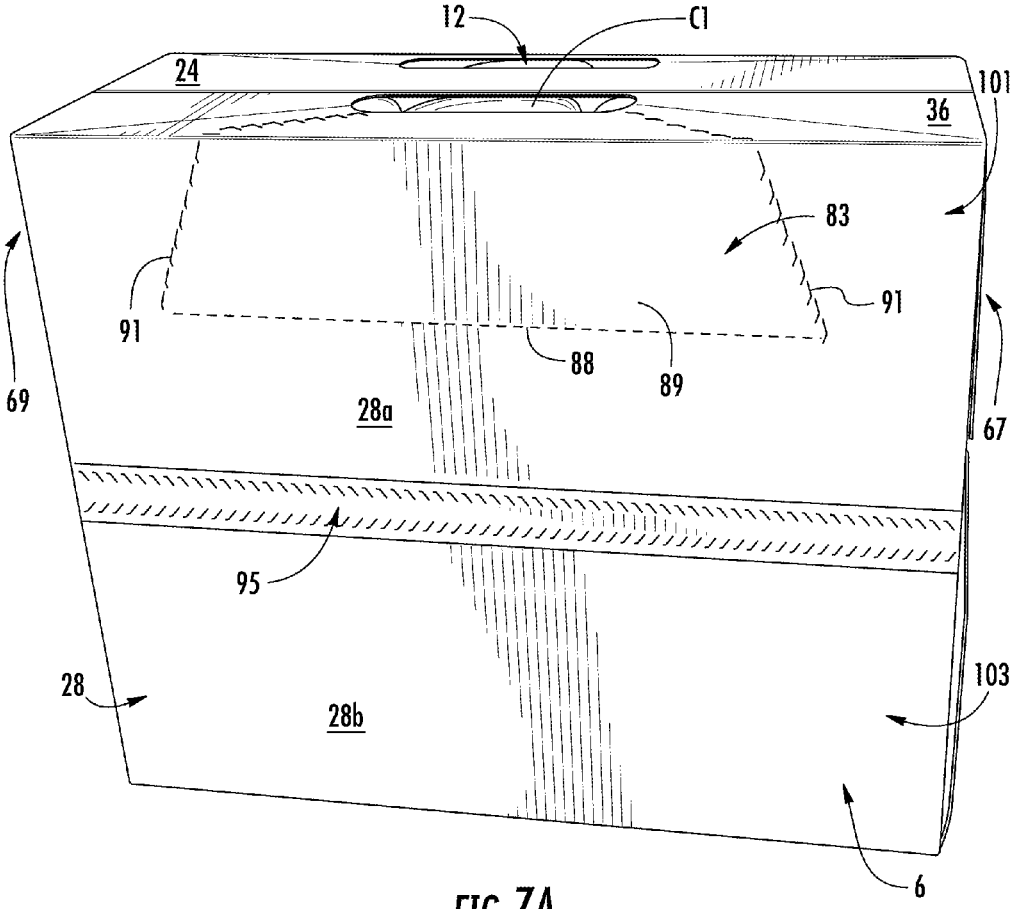
FIGS. 7A and 7B are perspective views of the erected carton according to the first exemplary embodiment of the disclosure.
Figure 7B:
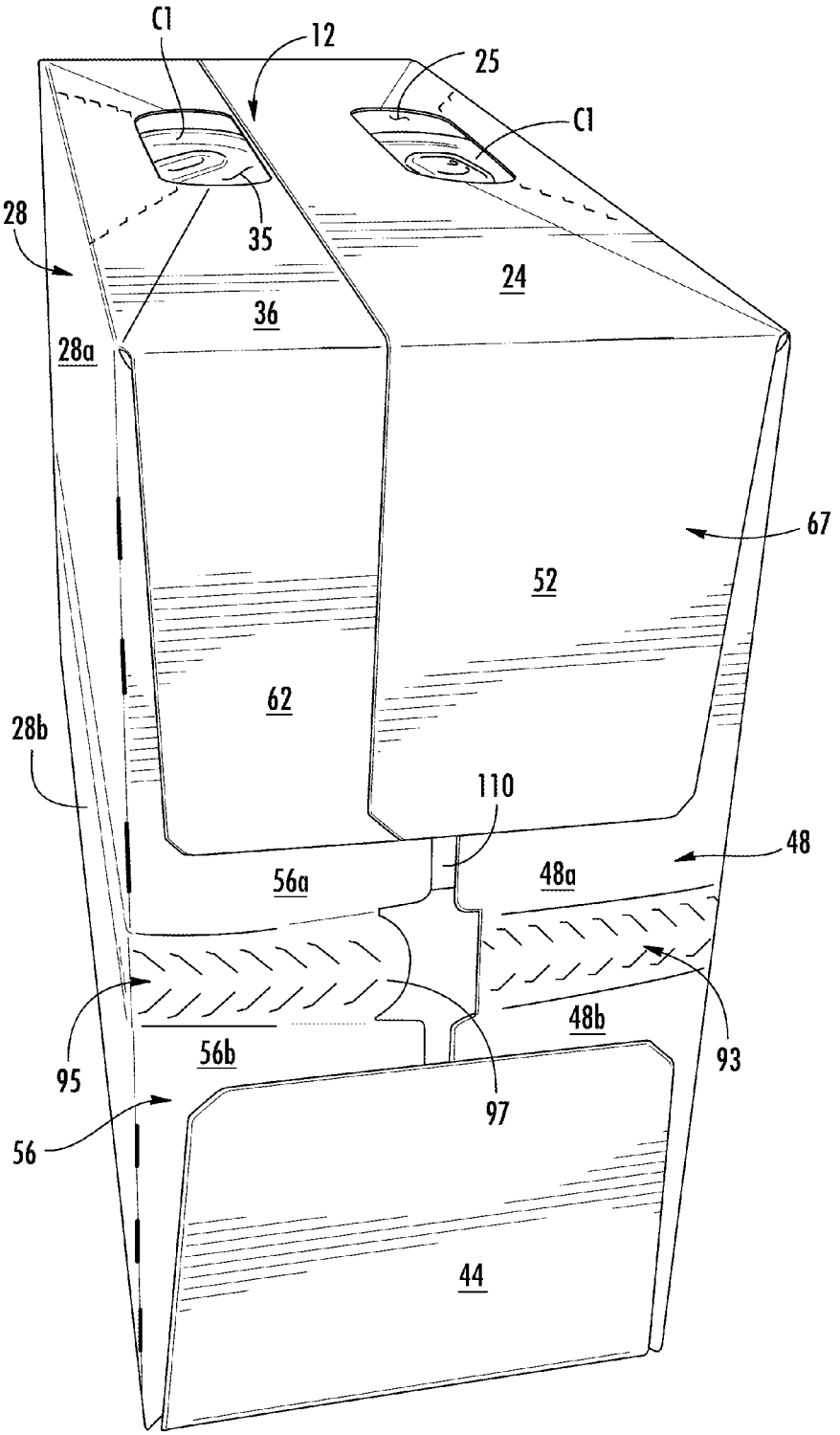

The erected carton 6 is shown in FIGS. 7A and 7B. The carton 6 includes the first modular section 101 and the second modular section 103 connected by the tear strips 93, 95. In the illustrated embodiment, the first modular section includes the first upper portion 18*a* of the first side panel 18, the first top panel 24, the second top panel 36, the reinforcement panel 70, the second upper portion 28*a* of the second side panel 28, the upper portions 48*a*, 50*a* of the respective side end flaps 48, 50, the upper portions 56*a*, 58*a* of the respective side end flaps 56, 58, the top end flaps 62, 64, the reinforcement end flaps 76, 77, and the divider 106. Additionally, the second modular section 103 can include the bottom panel 16, the first lower portion 18*b* of the first side panel 18, the second lower portion 28*b* of the second side panel 28, the bottom end flaps 44, 46, the lower portions 48*b*, 50*b* of the respective side end flaps 48, 50, and the lower portions 56*b*, 58*b* of the respective side end flaps 56, 58. In the illustrated embodiment, the side attachment flaps 118, 122 of the divider 106 are attached to the upper portions 18*a*, 28*a* of the respective side panels 18, 28 above the respective tear strips 93, 95. Similarly, the divider end flaps 110, 114 are overlapped by and/or adhered to the respective upper portions 48*a*, 56*a* and 50*a*, 58*a* of the respective side end flaps 48, 56, 50, 58 above the tear strips 93, 95 so that the divider 106 is disposed in the first modular section 101 above the second modular section 103 and above the containers C2 in the second layer T2. The first and second modular sections 101, 103 could be otherwise shaped, arranged, and/or configured without departing from the disclosure.

Figure 8:
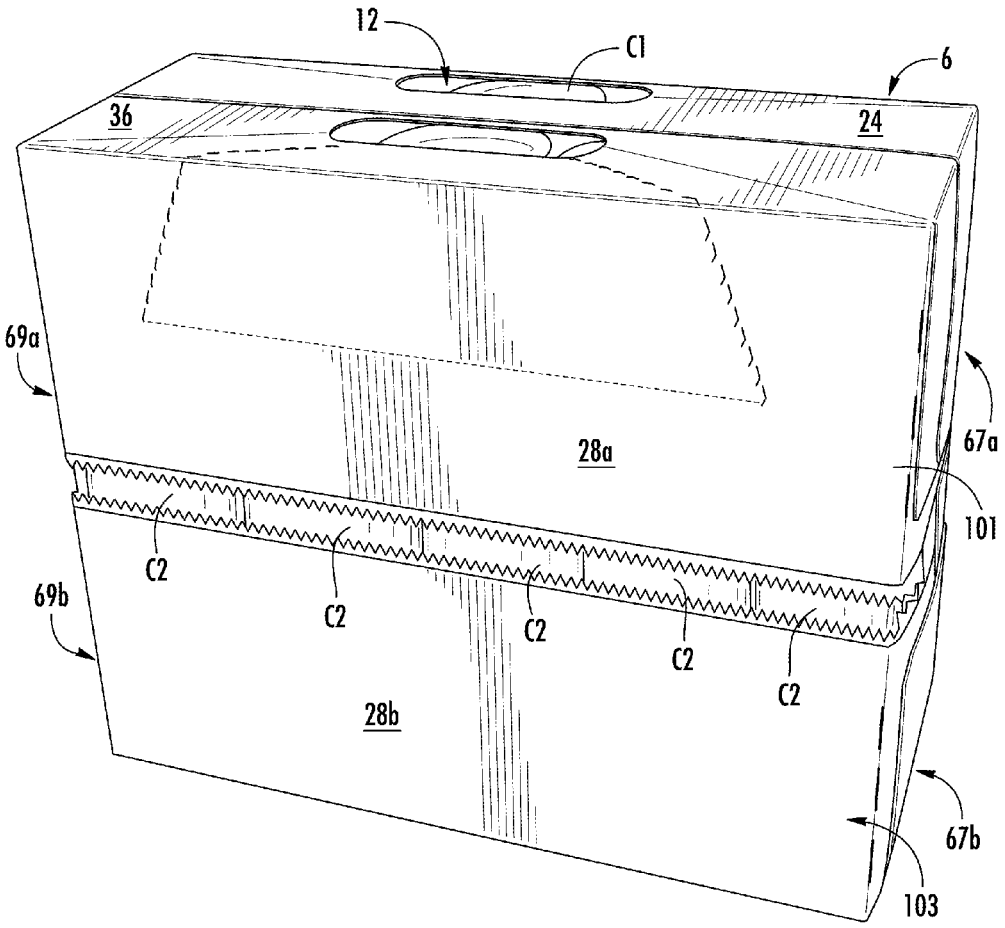
FIG. 8 is a perspective view of the carton of FIGS. 7A and 7B with an actuated separating feature.
Figure 9A:
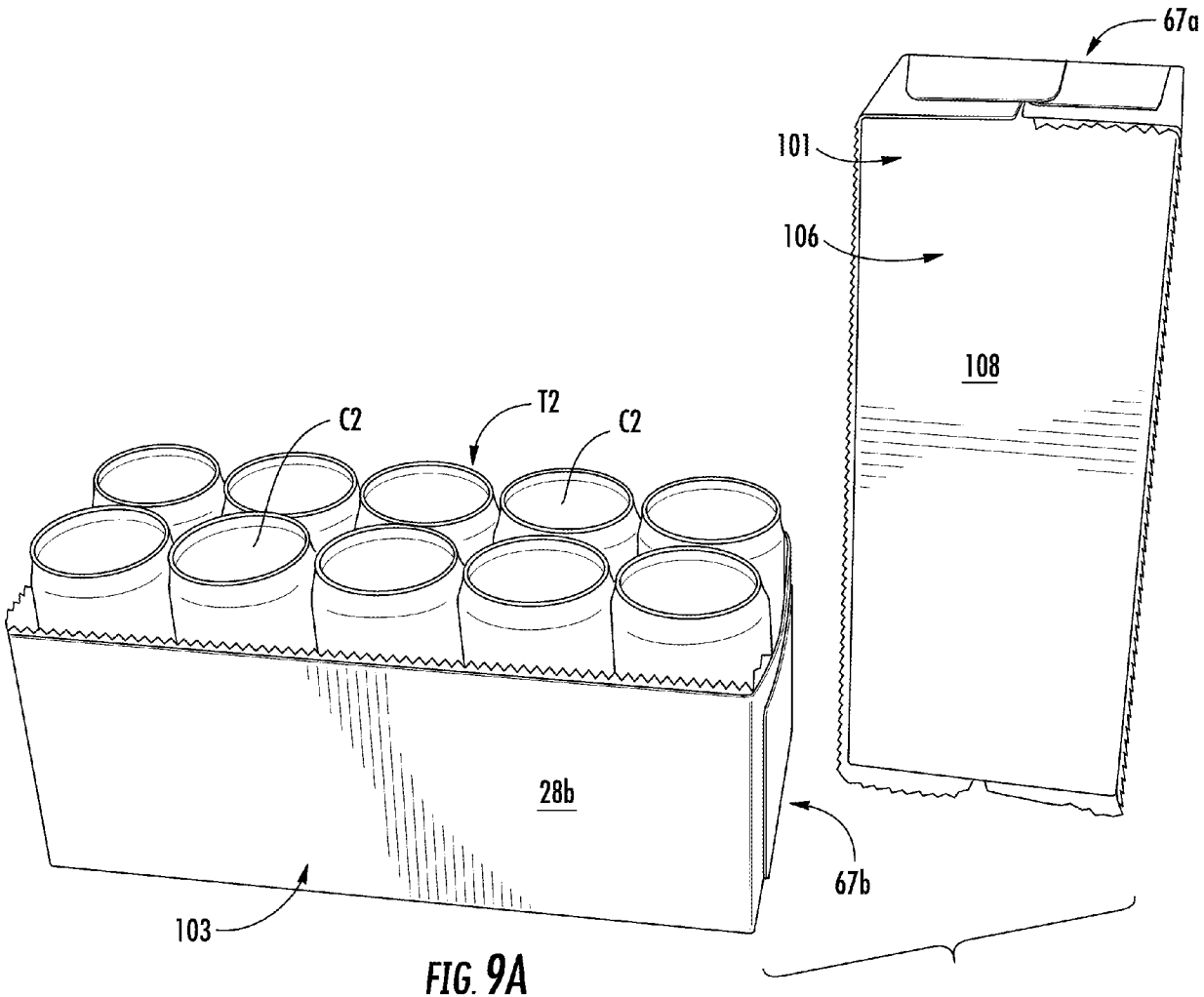
FIGS. 9A and 9B are perspective views of the carton of FIG. 8 separated into two sections 101, 103 according to the first exemplary embodiment of the disclosure.
Figure 9B:
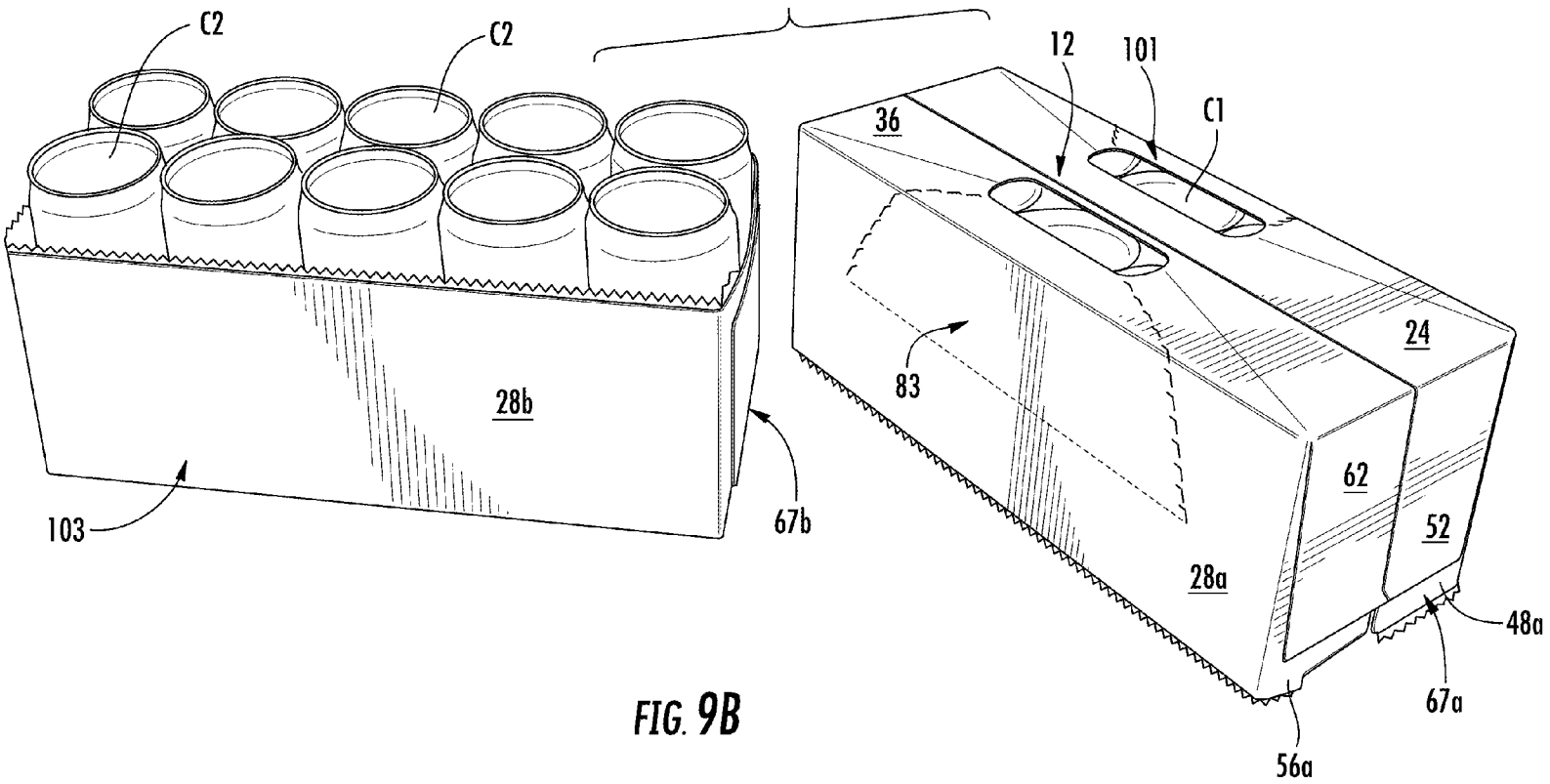

As shown in FIG. 8, the tear strips 93, 95 can be actuated to separate the first modular section 101 and the second modular section 103 of the carton 6. As shown in FIGS. 9A and 9B, after the tear strips 93, 95 are removed, the first modular section 101 can be lifted and carried at the handle 12 (e.g., FIG. 10B) to carry the top layer T1 of containers C1. In the illustrated embodiment, the tear strips 93, 95 are located below the divider 106 so that the first modular section 101 forms an enclosed container, which is at least partially enclosed by the top panels 25, 36, the reinforcement panel 70, the upper portions 18*a*, 28*a* of the side panels 18, 28, a first upper closed end 67*a* at least partially formed by the upper portions 48*a*, 56*a* of the side end flaps 48, 56, the top end flap 62, and the top reinforcing flap 76, and a second upper closed end 69*a* at least partially formed by the upper portions 50*a*, 56*a* of the side panels 50, 56, the top end flap 64, and the reinforcement end flap 77. In one embodiment, the central panel 108 of the divider 106 can form a bottom of the first modular section 101, supporting the containers C1 within the first modular section. In the illustrated embodiment, the second modular section 103 of the carton 6 comprises a tray that has an open top that provides access to the bottom layer T2 of containers C2 supported on the bottom panel 16. The tray of the second modular section 103 can be partially enclosed by the bottom panel 16, the lower portions 18*b*, 28*b* of the side panels 18, 28, a lower closed end 67*b* at least partially formed by the bottom end flap 44 and the lower portions 48*b*, 56*b* of the side end flaps 48, 56, and a second lower closed end 69*b* at least partially formed by the bottom end flap 46 and the lower portions 50*b*, 58*b* of the side end flaps 50, 58. In this way, the carton 6 is a modular carton that allows the containers C1 in the first modular section 101 to be separated and carried away from the containers C2 in the second marginal section 103. The carton 6 could be separated in an alternative manner by other features without departing from the disclosure.

Figure 10A:
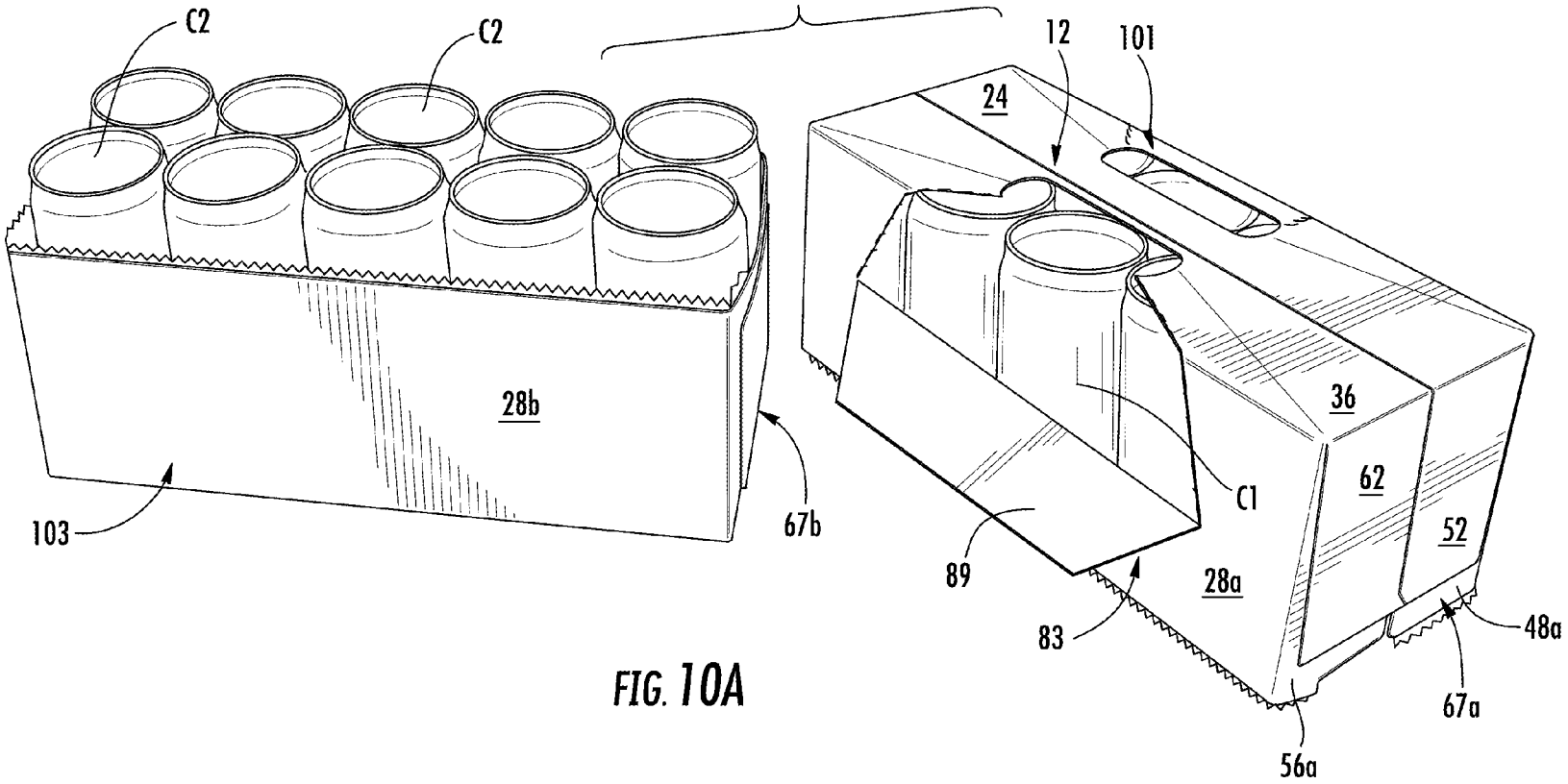
FIGS. 10A and 10B are perspective views of the separated of FIGS. 9A and 9B with an actuated dispenser.
Figure 10B:
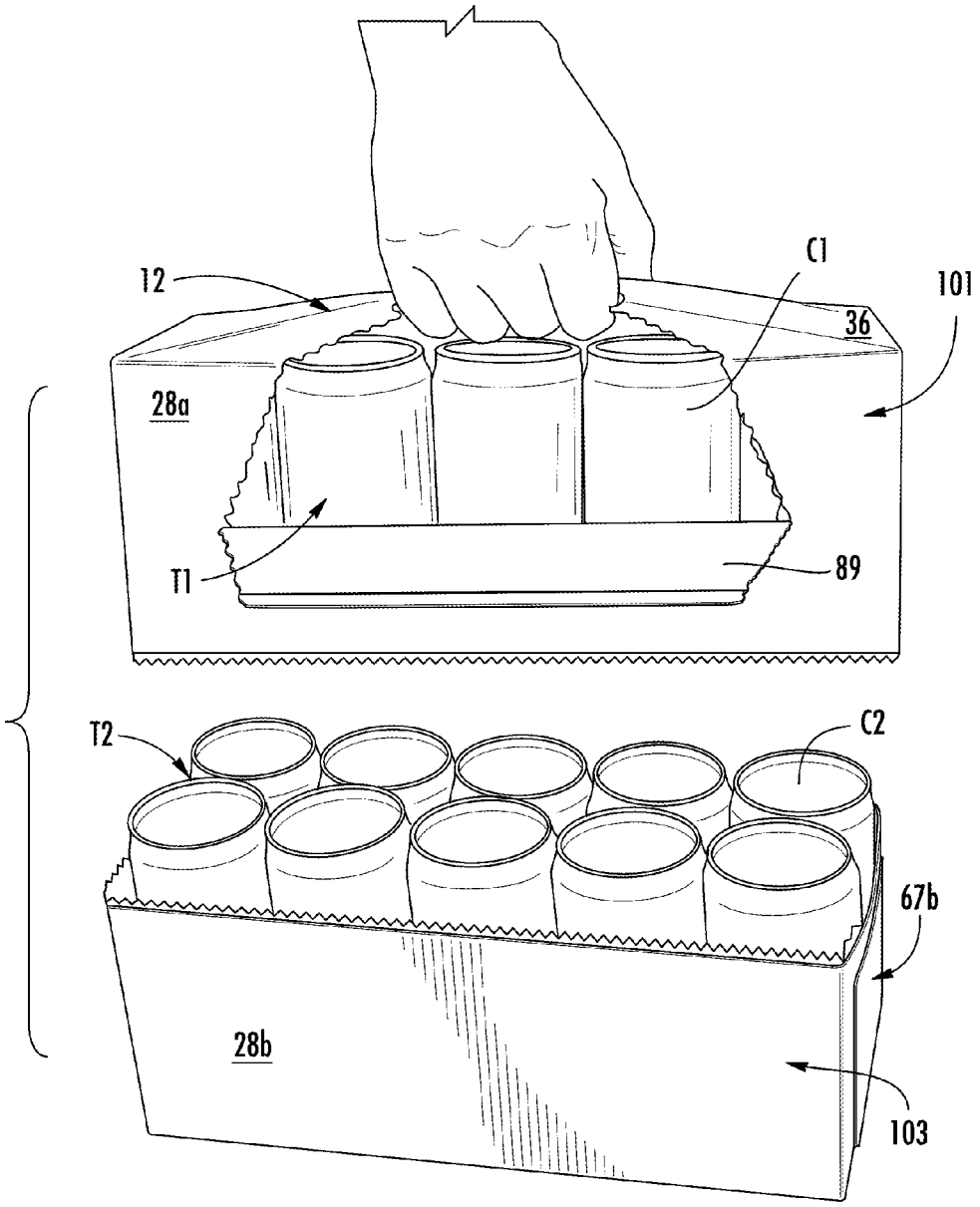

As shown in FIGS. 10A and 10B, one or both of the dispensers 81, 83 can be used to access the containers C1 in the first modular section 101 by tearing along respective tear lines 87, 91 to at least partially separate a respective dispenser panel 85, 89 from the first modular section. The first modular section 101 can be carried by grasping the handle 12 before or after (FIG. 10B) the dispenser(s) are actuated. In one embodiment, the carton 6 can be carried at the handle 12 prior to separating the modular sections from one another. Similarly, one or both of the dispensers 81, 83 could be actuated to access the containers C1 in the upper layer T1 before the modular sections are separated. The handle 12 and/or the dispensers 81, 83 could be otherwise actuated without departing from the disclosure.

The modular carton 6 with the separable first modular section 101 and second modular section 103 can be suitable for use with containers C1 in the upper modular section that contain a different product than the containers C2 in the lower modular section. Also, the containers C1, C2 in the upper and lower modular sections 101, 103 can be different sized containers that contain a different volume of beverage or other product. In one embodiment, containers C2 in the second modular section 103 are sized to contain 10.5 ounces of beverage, and the containers C1 in the first modular section 101 are sized to contain 7.5 ounces of beverage, with the containers C1, C2 having a similar or identical diameter, but the containers C2 being taller to accommodate higher volume of beverage. The containers C1, C2 could be otherwise shaped, configured, and/or arranged, such that the containers C1, C2 are the same size, or the containers C1, C2 are different size (e.g., in height and/or in diameter) without departing from the disclosure.

Figure 11:
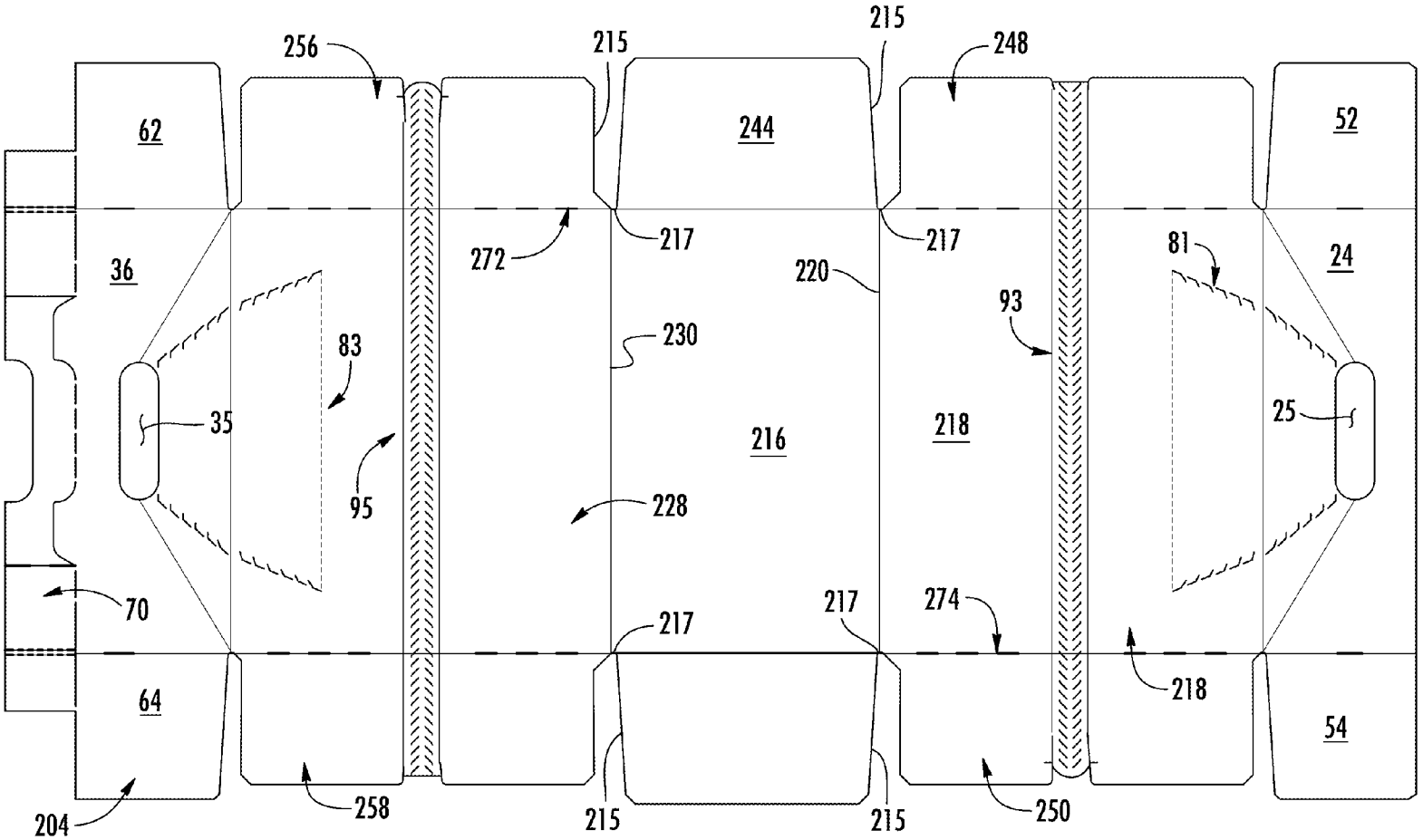
FIG. 11 is an exterior plan view of a carton blank used to form a carton according to a second exemplary embodiment of the disclosure.
Figure 12:
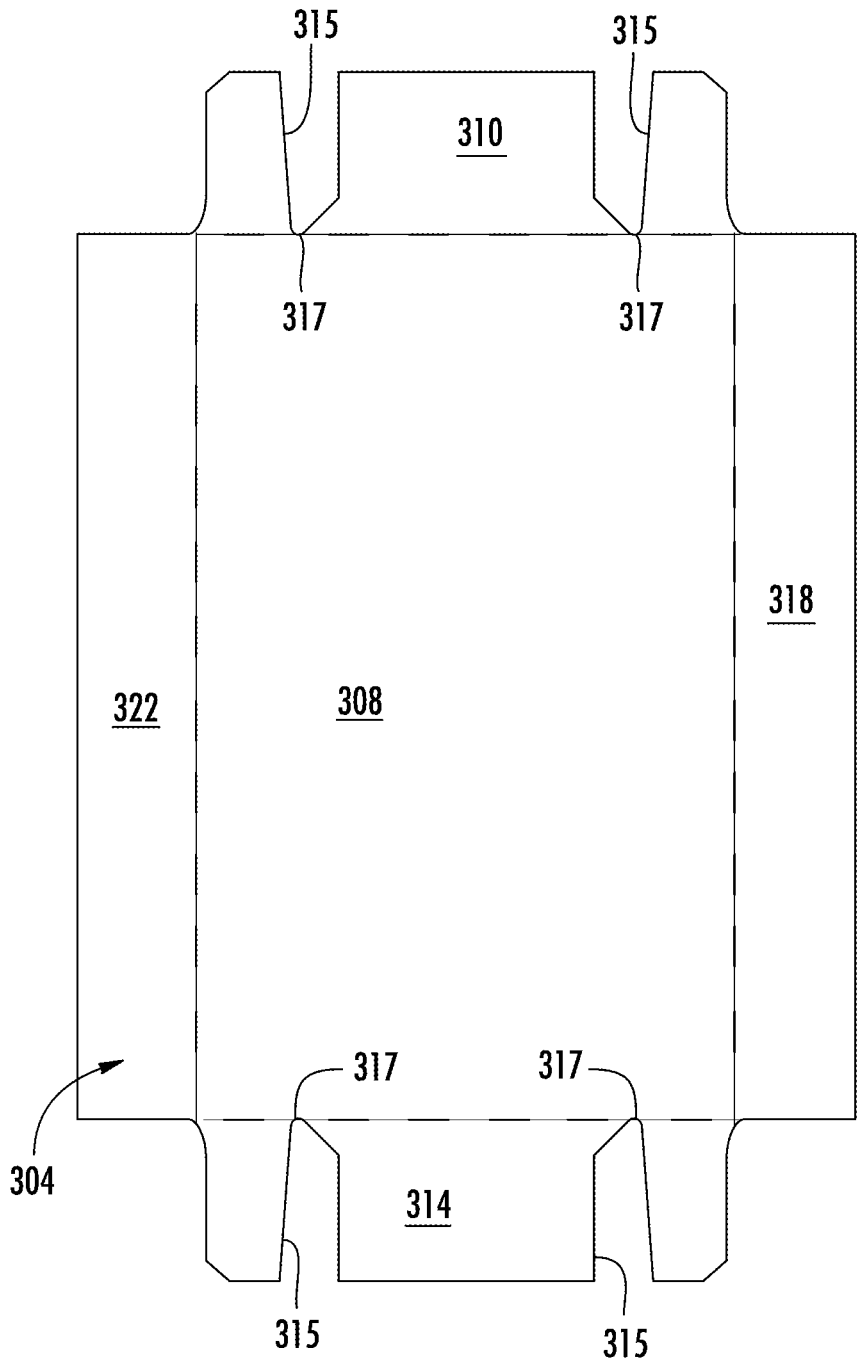
FIG. 12 is a plan view of a divider blank for forming a divider according to the second exemplary embodiment of the disclosure.
Figure 13:
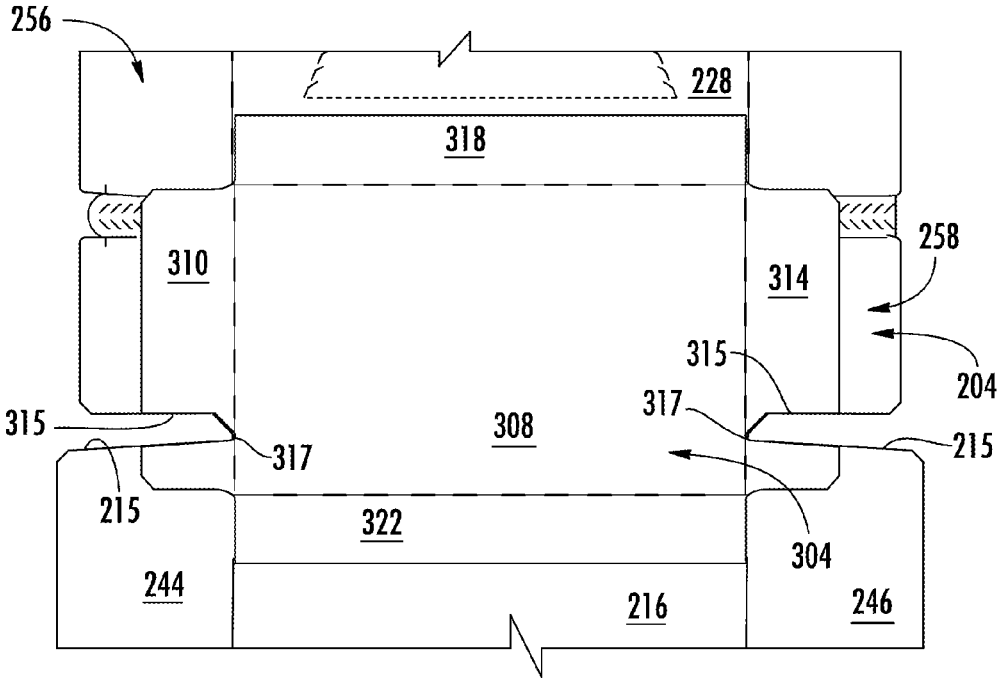
FIG. 13 is a plan view of the divider blank of FIG. 12 positioned on the carton blank of FIG. 11.

FIGS. 11-13 show a carton blank 204 and a divider blank 304 for forming a carton (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. In the second embodiment, the carton blank 204 and the divider blank 304 are sized to accommodate a 3×5×2 configuration of containers C1, C2. As shown in FIG. 11, the carton blank 204 includes four locating features or notches 215. In the illustrated embodiment, the notches 215 are defined along and between the bottom end flap 244 and the side end flap 248, the bottom end flap 244 and the side end flap 256, the bottom end flap 246 and the side end flap 250, and the bottom end flap 246 and the side end flap 258, respectively. Each of the notches 215 can extend along the edges of the respective end flaps and can come to a point or vertex 217 adjacent the respective intersection of the fold lines 272, 220, 230, 274.

As shown in FIG. 12, the end flaps 310, 314 of the divider blank 304 each include four locating features or notches 315 to assist in aligning the divider blank 304 with the carton blank 204 during the assembly process. In one embodiment, the divider blank 304 includes four notches 315 (FIG. 12) or the divider blank could include two notches 315 (FIG. 13). For example, in one embodiment, the four notches 315 can provide additional orientation options for alignment of the blanks. Each of the notches 315 can include a vertex 317 and can be similarly shaped as the notches 215 of the carton blank 204. As shown in FIG. 13, the notches 315 can be aligned with respective notches 215 (e.g., so that the vertexes 217, 317 generally line up with one another). When the desired notches 315, 215 are aligned, the first side attachment flap 318 can be adhesively secured to the second side panel 228 of the carton blank 204 in a similar manner of the first embodiment. The assembly of the carton of the second embodiment would then continue in a similar manner as noted above for the first embodiment to attach the second side attachment flap 322 to the first side panel 218 of the carton blank 204. The carton blank 204 of the second embodiment could have other features and could be otherwise shaped, arranged, and/or configured without departing from the disclosure. The divider blank 304 could have other features or could be otherwise shaped, arranged, and/or configured without departing from the disclosure.

Figure 14:
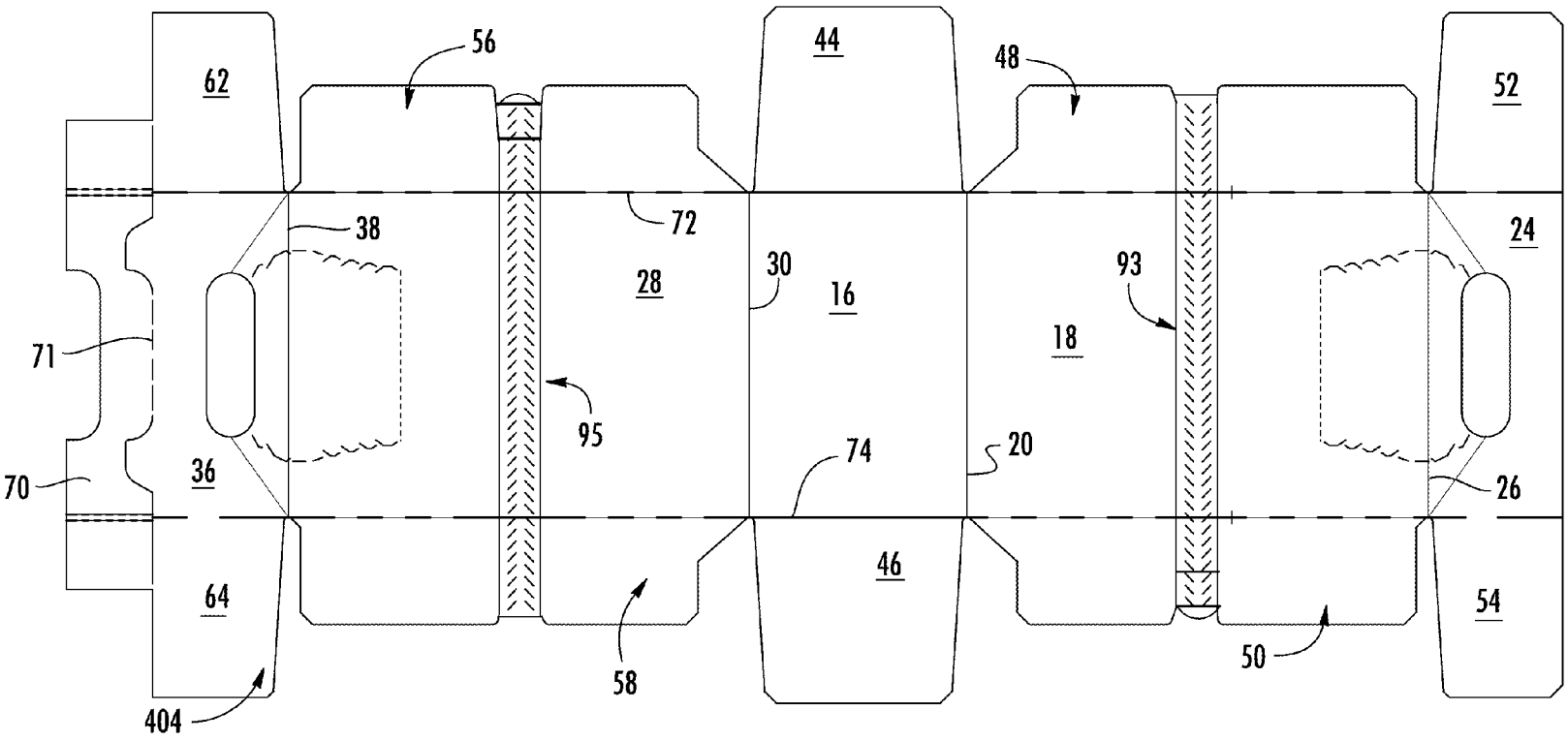
FIG. 14 is an exterior plan view of a carton blank used to form a carton according to a third exemplary embodiment of the disclosure.
Figure 15:
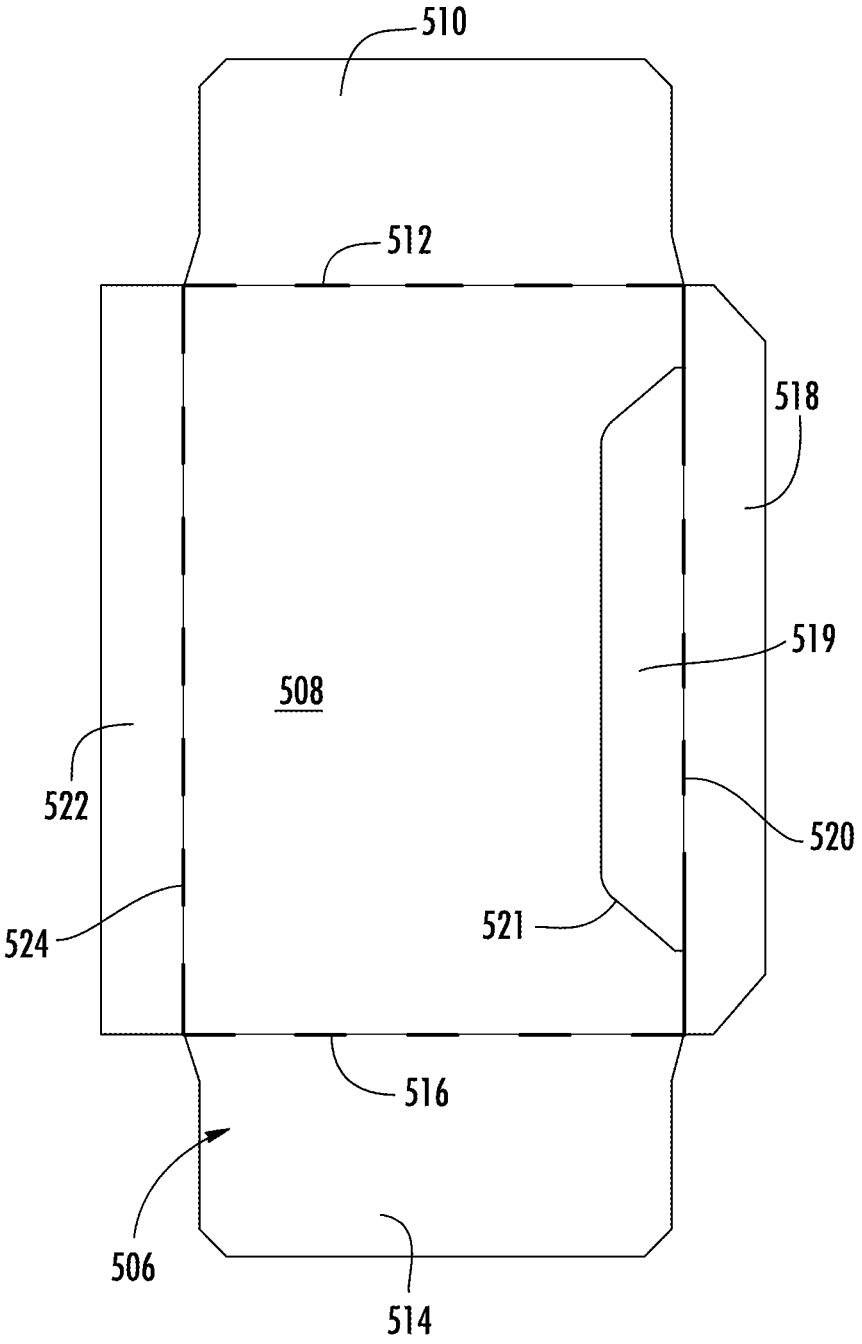
FIG. 15 is a plan view of a divider blank for forming a divider according to the third exemplary embodiment of the disclosure.

FIGS. 14 and 15 show carton blank 404 and an insert blank 504 for forming a carton (not shown) according to a third embodiment of the disclosure. The third embodiment is generally similar to the previous embodiments, except for variations noted and variations that will be apparent to one of ordinary skill in the art. Accordingly, similar or identical features of the embodiments have been given like or similar reference numbers. In the third embodiment, the carton blank 404 and the divider blank 504 are sized to accommodate a 2×3×2 configuration of containers C1, C2. As shown in FIG. 15, the divider blank 504 comprises a central panel 508, divider end flaps 510, 514 foldably connected to the central panel 508 along respective fold lines 512, 516, and side attachment flaps 518, 522 foldably connected to the central panel 508 along respective fold lines 520, 524. As shown in FIG. 15, the divider blank 504 includes an extension flap 519 extending from the side attachment flap 518 and at least partially defined by a cut 521 in the divider panel 508. In the illustrated embodiment, the extension flap 519 can be foldably connected to the side attachment flap 518 at the fold line 520. The divider blank 504 could have other features or could be otherwise shaped, arranged, and/or configured without departing from the disclosure. For example, the extension flap 519 could extend from the side attachment flap 518 without the fold line 520 (e.g., the cut line 521 and the extension flap 519 could interrupt the fold line 520).

Figure 16A:
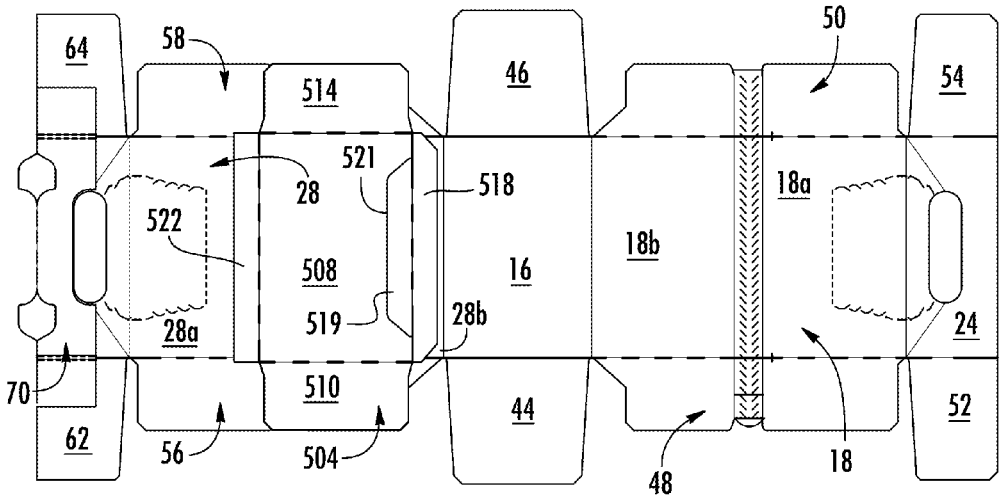
FIG. 16A-16C are plan views of the divider blank of FIG. 15 positioned on the carton blank of FIG. 14 and showing the folding of the carton blank and the divider blank to form an open-ended sleeve.
Figure 16B:
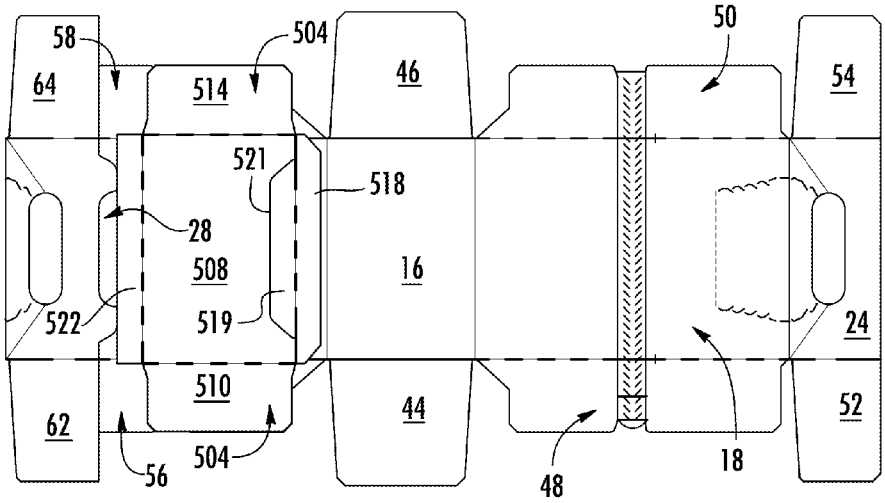
Figure 16C:
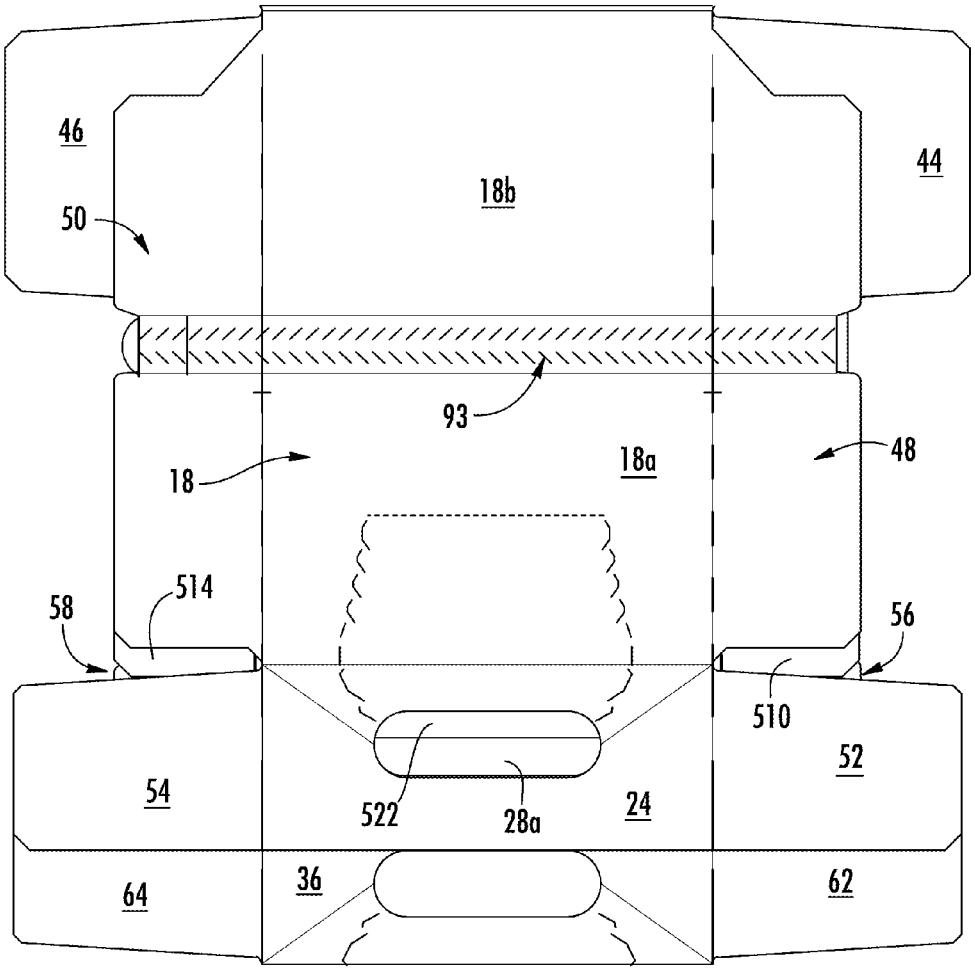

In the illustrated embodiment, the modular carton of the third embodiment can be assembled in a similar manner as the carton 6 of the first embodiment. As shown in FIG. 16A, the carton blank 404 and the divider blank 504 can be at least partially overlapped with the divider end flaps 510, 514 being aligned with the side end flaps 56, 58 similarly to the assembly of the blanks 4, 104 of the first embodiment (e.g., FIG. 3). Additionally, the second side attachment flap 522 can be adhered in face-to-face contact with the upper portion of the second side panel 28 of the carton blank 404. The first side attachment flap 518 can remain free from connection to the second side panel 28. Glue or other adhesive can be applied to the glue flap 519 before or after the initial attachment of the divider blank 504 to the carton blank 404. As shown in FIG. 16B, the second top panel 36 and the reinforcement panel 70 are folded over the side panel 28 similarly to the first embodiment. As shown in FIG. 16C, the first top panel 24 and the first side panel 18 and are folded over the bottom panel 16, the second side panel 18, and the divider blank 504 to the position shown in FIG. 16C. Accordingly, the first side panel 18 is in face-to-face contact with the extension flap 519 and the side attachment flap 518 and the extension flap can be attached the divider blank 504 to the first side panel 18 by the adhesive. As the panels of the carton blank are further folded to form the open-ended sleeve and the carton as described and shown in the first embodiment, the side attachment flaps 518, 522 and the extension flap 519 can fold with respect to the central panel 508 so that the side panels 18, 28, the side attachment flaps 518, 522, and the extension flap 519 are generally vertical and the central panel 508 is generally horizontal in the open ended sleeve and the carton. Accordingly, the divider formed by the divider blank 504 is attached to the second side panel 28 by way of the second attachment flap 522 and is attached to the first side panel 18 by way of the extension flap 519. The central panel 508 then spans between the two side panels 18, 28 in the erected carton in a similar manner as the carton 6 of the first embodiment. In the illustrated embodiment, as the extension flap 519 folds with the side attachment flap 518 with respect to the central panel 508, the extension flap 519 can separate from the central panel along the cut line 521 to form an opening extending in the central panel 508 adjacent the extension flap and the side attachment flap. In one embodiment, an advantage of the third embodiment is that the step of folding the side attachment flap 118 (e.g., as shown in FIG. 4A) can be omitted since the first side panel 18 can be glued to the extension flap 519. The carton of the third embodiment can be loaded in a similar manner as the carton of the first embodiment without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles in at least a first layer and a second layer, the carton comprising:

a plurality of panels extending at least partially around an interior of the carton, the plurality of panels comprising at least a bottom panel, a first side panel, a second side panel disposed opposite to the first side panel, and a top panel; and a divider for at least partially extending between the first layer and the second layer of the plurality of articles, the divider is adhered to at least one panel of the plurality of panels, the divider comprises a central panel foldably connected to each of a first attachment flap and a second attachment flap, the divider at least partially defining a first modular section of the carton and a second modular section of the carton, the first modular section comprising the top panel, a first upper portion of the first side panel, a second upper portion of the second side panel, and the divider, the second modular section comprising the bottom panel, a first lower portion of the first side panel, and a second lower portion of the second side panel, the first attachment flap is in face-to-face contact with the first upper portion and adhered to the first upper portion of the first side panel and the second attachment flap is in face-to-face contact with the second upper portion and adhered to the second upper portion of the second side;

wherein the central panel of the divider supports the first layer of the plurality of articles, the bottom panel supports the second layer of the plurality of articles, and the first modular section is at least partially separable from the second modular section.

2. The carton of claim 1, wherein the first modular section of the carton is an at least partially closed container at least partially containing the first layer of the plurality of articles and the second modular section is a tray at least partially containing the second layer of the plurality of articles.

3. The carton of claim 1, wherein the first upper portion of the first side panel, the second upper portion of the second side panel, the top panel and the central panel are for at least partially enclosing the first layer of the plurality of articles.

4. The carton of claim 1, wherein the first upper portion is separable from the first lower portion along a first separating feature, the second upper portion is separable from the second lower portion along a second separating feature, and the first attachment flap and the second attachment flap are at least partially adhered to the respective first upper portion and second upper portion above the respective first separating feature and second separating feature, the first separating feature and the second separating feature for being actuated to at least partially separate the first modular section from the second modular section.

5. The carton of claim 1, wherein the divider comprises an extension flap extending from the second attachment flap, the extension flap extending upwardly from the central panel, and the second attachment flap extending downwardly from the central panel.

6. The carton of claim 5, wherein the extension flap and the second attachment flap extend adjacent an opening in the central panel.

7. The carton of claim 5, wherein the first attachment flap and the extension flap are adhered to the respective first upper portion and second upper portion.

8. The carton of claim 5, wherein the extension flap is foldably connected to the second attachment flap along a fold line.

9. The carton of claim 1, further comprising a plurality of end flaps respectively foldably connected to respective panels of the plurality of panels, the plurality of end flaps being at least partially overlapped with respect to one another to thereby at least partially form a closed end of the carton, wherein the divider further comprises a divider end flap foldably connected to the central panel, and at least one end flap of the plurality of end flaps at least partially overlaps the divider end flap at the closed end of the carton.

10. The carton of claim 9, wherein the divider comprises at least a first locating feature extending in the divider end flap and the carton further comprises at least a second locating feature defined between at least two end flaps of the plurality of end flaps during at least a portion of formation of the carton from a carton blank and a divider blank.

11. The carton of claim 10, wherein the plurality of end flaps comprises a bottom end flap foldably connected to the bottom panel, a first side end flap foldably connected to the first side panel, and a second side end flap foldably connected to the second side panel, the first locating feature comprises a first notch extending in the divider end flap and the second locating feature comprises a second notch extending along the bottom end flap and at least one of the first side end flap and the second side end flap during the formation of the carton from the carton blank and the divider blank, the first notch being generally aligned with the second notch during at least a portion of the formation of the carton from the carton blank and the divider blank.

12. The carton of claim 1, wherein the first upper portion of the first side panel is at least partially separable from the first lower portion of the first side panel along a first separating feature and the second upper portion of the second side panel is at least partially separable from the second lower portion of the second side panel along a second separating feature, the divider being attached to the first upper portion of the first side panel above the first separating feature, the divider being attached to the second upper portion of the second side panel above the second separating feature, the first separating feature being for at least partially separating the first upper portion from the first lower portion and the second separating feature being for at least partially separating the second upper portion from the second lower portion such that the first separating feature and the second separating feature are for at least partially separating the first modular section from the second modular section.

13. The carton of claim 12, wherein the first separating feature comprises a first tear strip extending in at least the first side panel and the second separating feature comprises a second tear strip extending in at least the second side panel.

14. The carton of claim 12, further comprising a plurality of end flaps respectively foldably connected to respective panels of the plurality of panels, the plurality of end flaps being at least partially overlapped with respect to one another to thereby at least partially form a closed end of the carton, the plurality of end flaps comprising at least a first side end flap foldably connected to the first side panel and a second side end flap foldably connected to the second side panel, the first separating feature extending in the first side end flap and the second separating feature extending in the second side end flap.

15. The carton of claim 1, further comprising a handle extending in at least the top panel for carrying at least the first modular section.

16. The carton of claim 1, further comprising a dispenser extending in at least one of the first upper portion of the first side panel and the second upper portion of the second side panel, wherein the dispenser is for being actuated to access at least the articles in the first layer of the plurality of articles.

17. The carton of claim 1, wherein the articles in the first layer of the plurality of articles are different from the articles in the second layer of the plurality of articles.

18. In combination, a carton blank and a divider blank for forming a carton for holding a plurality of articles in at least a first layer and a second layer:

the carton blank comprising a plurality of panels comprising at least a bottom panel, a first side panel, a second side panel, and a top panel; and the divider blank at least partially overlapping the carton blank, the divider blank being for at least partially extending between the first layer and the second layer of the plurality of articles when the carton is formed from the carton blank and the divider blank, the divider blank is adhered to at least one panel of the plurality of panels, the divider blank comprises a central panel foldably connected to each of a first attachment flap and a second attachment flap, the divider blank being for at least partially defining a first modular section of the carton formed from the carton blank and the divider blank and a second modular section of the carton formed from the carton blank and the divider blank, the first modular section being for comprising the top panel, a first upper portion of the first side panel, a second upper portion of the second side panel, and the divider formed from the divider blank, the second modular section being for comprising the bottom panel, a first lower portion of the first side panel, and a second lower portion of the second side panel, the first attachment flap is in face-to-face contact with the first upper portion and adhered to the first upper portion of the first side panel and the second attachment flap is in face-to-face contact with the second upper portion and adhered to the second upper portion of the second side panel;

wherein the central portion of the divider blank is for at least partially supporting the first layer of the plurality of articles, the bottom panel is for at least partially supporting the second layer of the plurality of articles, and the first modular section is at least partially separable from the second modular section when the carton is formed from the carton blank and the divider blank.

19. The combination of claim 18, wherein the divider blank comprises an extension flap extending from the second attachment flap, the extension flap being at least partially separable from the central panel along a cut line.

20. The combination of claim 19, wherein the first attachment flap is adhered to the first upper portion of the first side panel and the extension flap is for being adhered to the second upper portion of the second side panel when the carton is formed from the carton blank and the divider blank.

21. The combination of claim 19, wherein the extension flap is foldably connected to the second attachment flap along a fold line.

22. The combination of claim 18, further comprising a plurality of end flaps respectively foldably connected to respective panels of the plurality of panels, the plurality of end flaps for being at least partially overlapped with respect to one another to thereby at least partially form a closed end of the carton formed from the carton blank and the divider blank, wherein the divider blank further comprises a divider end flap foldably connected to the central panel, and at least one end flap of the plurality of end flaps is for at least partially overlapping the divider end flap at the closed end when the carton is formed from the carton blank and the divider blank.

23. The combination of claim 22, wherein the divider blank comprises at least a first locating feature extending in the divider end flap and the carton blank further comprises at least a second locating feature defined between at least two end flaps of the plurality of end flaps, the first locating feature being generally aligned with the second locating feature to at least partially position the divider blank on the carton blank.

24. The combination of claim 23, wherein the plurality of end flaps comprises a bottom end flap foldably connected to the bottom panel, a first side end flap foldably connected to the first side panel, and a second side end flap foldably connected to the second side panel, the first locating feature comprises a first notch extending in the divider end flap and the second locating feature comprises a second notch extending along the bottom end flap and at least one of the first side end flap and the second side end flap, the first notch being generally aligned with the second notch.

25. The combination of claim 24, wherein the first notch comprises a first vertex and the second notch comprises a second vertex, the first vertex and the second vertex being generally aligned.

26. The combination of claim 22, wherein the divider blank comprises at least a first locating feature extending along a first corner of the divider end flap and the carton blank further comprises at least a second locating feature extending along a second corner of an end flap of the plurality of end flaps, the first locating feature being generally aligned with the second locating feature to at least partially position the divider blank on the carton blank.

27. The combination of claim 26, wherein the plurality of end flaps comprises a first side end flap foldably connected to the first side panel and second side end flap foldably connected to the second side panel, the second locating feature extending in at least one of the first side end flap and the second side end flap.

28. The combination of claim 18, wherein the first upper portion of the first side panel is at least partially separable from the first lower portion of the first side panel along a first separating feature and the second upper portion of the second side panel is at least partially separable from the second lower portion of the second side panel along a second separating feature, the divider blank being attached to the first upper portion of the first side panel above the first separating feature, the divider blank being attached to the second upper portion of the second side panel above the second separating feature, the first separating feature being for at least partially separating the first upper portion from the first lower portion and the second separating feature being for at least partially separating the second upper portion from the second lower portion such that the first separating feature and the second separating feature are for at least partially separating the first modular section from the second modular section when the carton is formed from the carton blank and the divider blank.

29. The combination of claim 28, wherein the first separating feature comprises a first tear strip extending in at least the first side panel and the second separating feature comprises a second tear strip extending in at least the second side panel.

30. The combination of claim 28, further comprising a plurality of end flaps respectively foldably connected to respective panels of the plurality of panels, the plurality of end flaps comprising at least a first side end flap foldably connected to the first side panel and a second side end flap foldably connected to the second side panel, the first separating feature extending in the first side end flap and the second separating feature extending in the second side end flap.

31. A method of forming a carton for holding a plurality of articles in at least a first layer and a second layer, the method comprising:

obtaining a carton blank and a divider blank, the carton blank comprising a plurality of panels comprising at least a bottom panel, a first side panel, a second side panel, and a top panel, the divider blank comprising a central panel foldably connected to each of a first attachment flap and a second attachment flap;

at least partially overlapping the divider blank and the carton blank and adhering the first attachment flap in face-to-face contact with a first upper portion of the first side panel and adhering the second attachment flap in face-to-face contact with a second upper portion of the second side panel;

positioning the plurality of panels to at least partially form an interior of the carton; and forming the divider blank into a divider at least partially extending between the first layer and the second layer of the plurality of articles, the forming the divider comprising adhering the divider to at least one panel of the plurality of panels and at least partially defining a first modular section of the carton and a second modular section of the carton, the first modular section comprising the top panel, the first upper portion of the first side panel, the second upper portion of the second side panel, and the divider, the second modular section comprising the bottom panel, a first lower portion of the first side panel, and a second lower portion of the second side panel;

wherein the central panel of the divider is for at least partially supporting the first layer of the plurality of articles, the bottom panel is for at least partially supporting the second layer of the plurality of articles, and the first modular section is at least partially separable from the second modular section.

32. The method of claim 31, wherein the positioning the plurality of panels comprises folding the second attachment flap to at least partially overlap the central panel prior to the positioning the second side panel to at least partially overlap the second attachment flap, and the positioning the second side panel to at least partially overlap the second attachment flap comprises folding the second side panel with respect to the bottom panel so that the second upper portion of the second side panel at least partially overlaps the second attachment flap.

33. The method of claim 31, wherein the divider blank further comprises an extension flap extending from the second attachment flap, and the positioning the second side panel to at least partially overlap the second attachment flap comprises folding the second side panel with respect to the bottom panel so that the second upper portion of the second side panel at least partially overlaps the extension flap.

34. The method of claim 33, further comprising adhering at least the extension flap in face-to-face contact with the second upper portion of the second side panel.

35. The method of claim 34, wherein the extension flap of the divider blank is at least partially defined by a cut line extending in the central panel, and the positioning the plurality of panels further comprises folding the plurality of panels relative to one another to at least partially form an open-ended sleeve, the folding the plurality of panels relative to one another causing at least the first attachment flap and the extension flap to fold with respect to the central panel, the extension flap at least partially separating from the central panel along the cut line.

36. The method of claim 31, wherein:

the carton blank further comprises a plurality of end flaps respectively foldably connected to respective panels of the plurality of panels;

the divider blank further comprises a divider end flap foldably connected to the central panel; and the method further comprising forming an at least partially closed end of the carton by at least partially overlapping the plurality of end flaps with respect to one another and by at least partially overlapping the divider end flap with at least one end flap of the plurality of end flaps.

37. The method of claim 36, wherein the divider blank further comprises at least a first locating feature extending in the divider end flap, the carton blank further comprises at least a second locating feature defined between at least two end flaps of the plurality of end flaps, and the at least partially overlapping the divider blank and the carton blank comprises positioning the divider blank on the carton blank by generally aligning the first locating feature with the second locating feature.

38. The method of claim 37, wherein:

the plurality of end flaps comprises a bottom end flap foldably connected to the bottom panel, a first side end flap foldably connected to the first side panel, and a second side end flap foldably connected to the second side panel;

the first locating feature comprises a first notch extending in the divider end flap and the second locating feature comprises a second notch extending along the bottom end flap and at least one of the first side end flap and the second side end flap; and the generally aligning the first locating feature with the second locating feature comprises generally aligning the first notch with the second notch.

39. The method of claim 36, wherein:

the divider blank comprises a first locating feature extending along a first corner of the divider end flap and the carton blank comprises a second locating feature extending along a second corner of an end flap of the plurality of end flaps; and the at least partially overlapping the divider blank and the carton blank comprises positioning the divider blank on the carton blank by generally aligning the first corner with the second corner.

40. The carton of claim 1, wherein the divider is adhered to the at least one panel of the plurality of panels with an adhesive.

41. The combination of claim 18, wherein the divider blank is adhered to the at least one panel of the plurality of panels with an adhesive.

42. A carton comprising a plurality of modular sections, the plurality of modular sections comprising:

a first modular section comprising a first portion of a first side panel, a first portion of a second side panel, a top panel extending between the first portion of the first side panel and the first portion of the second side panel, and a divider extending between the first portion of the first side panel and the first portion of the second side panel, the divider comprises a central panel foldably connected to each of a first attachment flap and a second attachment flap, the first attachment flap is in face-to-face contact with and adhered to the first portion of the first side panel, and the second attachment flap is in face-to-face contact with and adhered to the first portion of the second side panel, the first modular section enclosing a first plurality of articles, and the top panel foldably connected to the first portion of the first side panel and the first portion of the second side panel; and a second modular section separated from the first modular section and comprising a second portion of the first side panel, a second portion of the second side panel, and a bottom panel extending between the second portion of the first side panel and the second portion of the second side panel, the second modular section supporting a second plurality of articles, the second modular section has an open top that provides access to the second plurality of articles.

* * * * *